US010479663B2

(12) United States Patent
Warner

(10) Patent No.: US 10,479,663 B2
(45) Date of Patent: Nov. 19, 2019

(54) FORKLIFT TRUCKS AND MASTS THEREFORE

(71) Applicant: Hyster-Yale Group, Inc., Fairview, OR (US)

(72) Inventor: Barry Warner, Basingstoke (GB)

(73) Assignee: HYSTER-YALE GROUP, INC., Fairview, OR (US)

( * ) Notice: Subject to any disclaimer, the term of this patent is extended or adjusted under 35 U.S.C. 154(b) by 283 days.

(21) Appl. No.: 15/267,518

(22) Filed: Sep. 16, 2016

(65) Prior Publication Data

US 2017/0073203 A1 Mar. 16, 2017

Related U.S. Application Data

(60) Provisional application No. 62/219,217, filed on Sep. 16, 2015.

(51) Int. Cl.

| | |
|---|---|
| ***B66F 9/08*** | (2006.01) |
| ***B66F 9/22*** | (2006.01) |
| ***F15B 11/10*** | (2006.01) |

(52) U.S. Cl.

CPC ..... *B66F 9/22* (2013.01); *B66F 9/08* (2013.01); *F15B 11/10* (2013.01); *F15B 2211/50* (2013.01)

(58) Field of Classification Search

CPC .... B66F 9/22; B66F 9/08; B66F 9/205; F15B 11/10

USPC ..... 60/459

See application file for complete search history.

(56) References Cited

U.S. PATENT DOCUMENTS

| | | | | |
|---|---|---|---|---|
| 2,634,587 A | 4/1953 | Ptak | | |
| 4,593,791 A | 6/1986 | Matthews | | |
| 4,889,038 A * | 12/1989 | Bentivoglio | B66F 9/08 | 187/226 |
| 2009/0292427 A1* | 11/2009 | Yamada | B66F 9/22 | 701/50 |

FOREIGN PATENT DOCUMENTS

| | | |
|---|---|---|
| GB | 2 407 808 A | 5/2005 |
| JP | S61 163300 U | 10/1986 |
| JP | 2000 016795 A | 1/2000 |
| JP | 2012 250819 A | 12/2012 |

OTHER PUBLICATIONS

European Patent Office; "European Search Report" for EP App. No. EP16189178; dated Feb. 22, 2017; 11 pages.

* cited by examiner

*Primary Examiner* — Michael Leslie
*Assistant Examiner* — Daniel S Collins
(74) *Attorney, Agent, or Firm* — Schwabe Williamson & Wyatt

(57) ABSTRACT

A hydraulic circuit for a lift truck comprises a feed-through cylinder communicating with a free lift cylinder and a lift cylinder.

26 Claims, 20 Drawing Sheets

FORKLIFT TRUCKS AND MASTS THEREFORE

SUMMARY

Unique cross-sectional profiles for multi-stage lift truck mast columns provide relatively narrow mast columns. For example, an exemplary mast column for a mast with a lifting capacity of 2.0 to 2.5 tons has a width of approximately 11 centimeters. In comparison, commonly available mast columns for a mast with a lifting capacity of 2.0 to 2.5 tons have a width of approximately 15 centimeters.

A hydraulic circuit for a lift truck comprises a feed-through cylinder communicating with a free lift cylinder and a lift cylinder.

DETAILED DESCRIPTION

Figure 10:
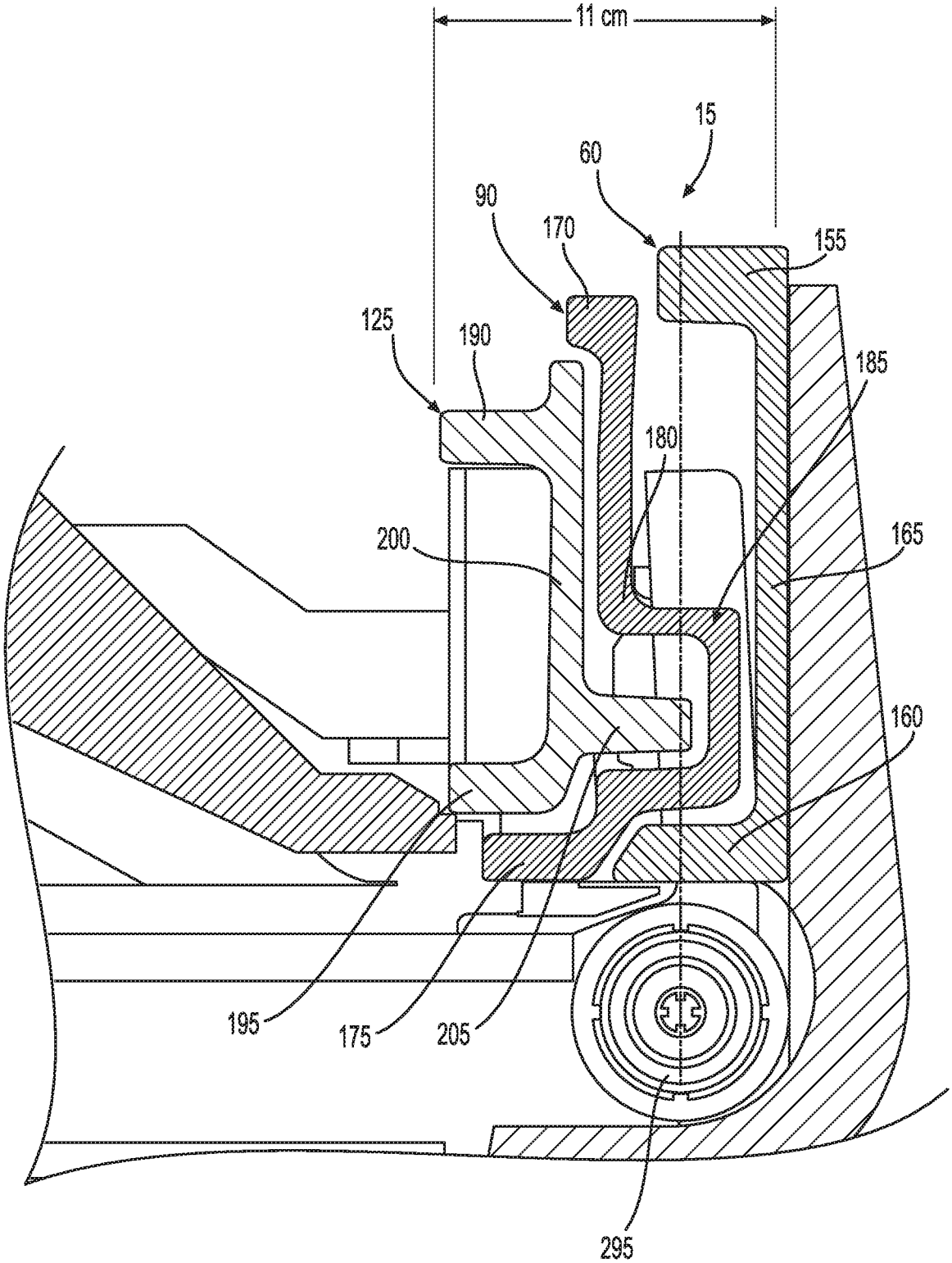
FIG. 10 illustrates a cross sectional view of the mast of FIG. 1 taken along sectional line 10-10 (FIG. 1).
Figure 21:
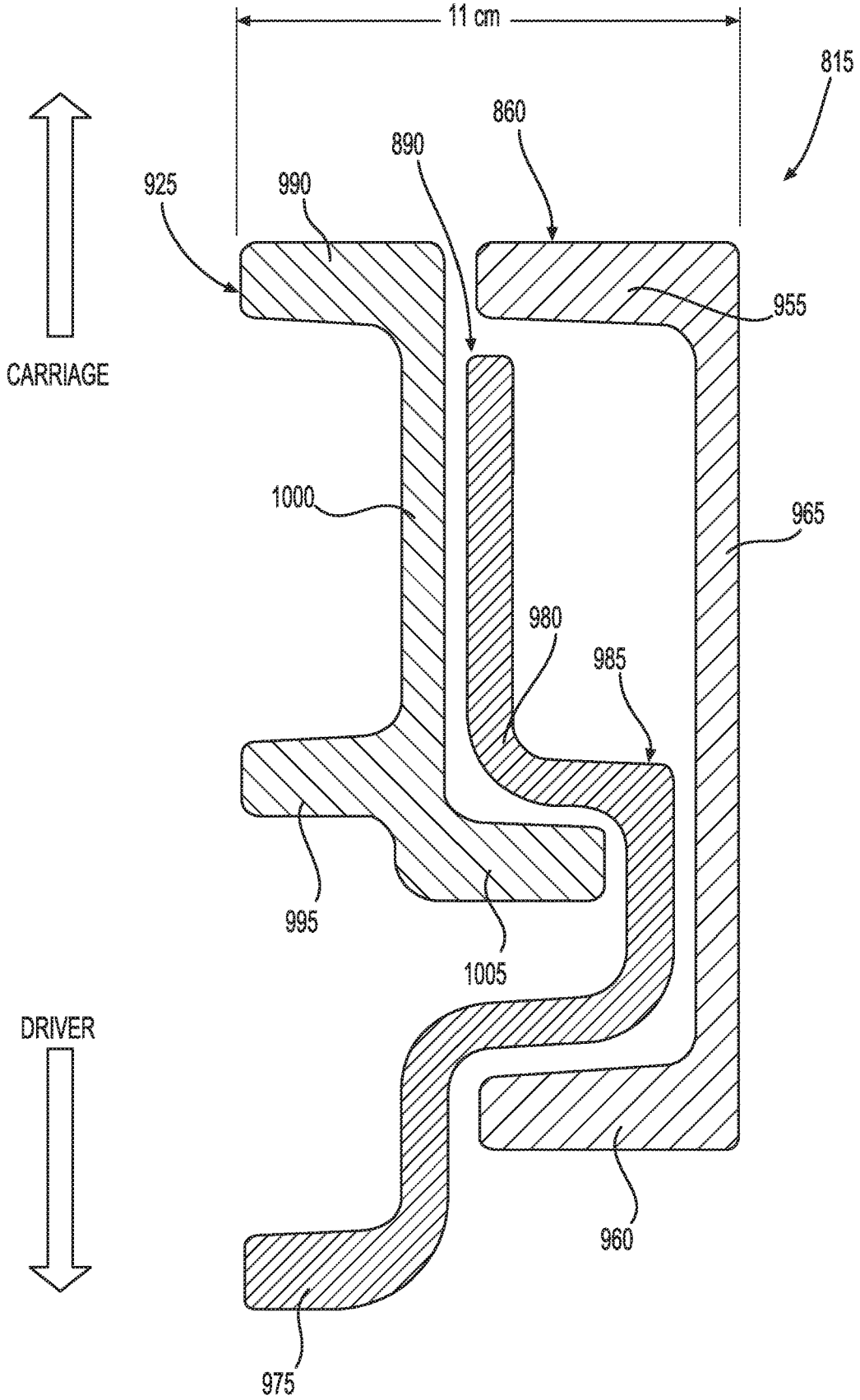
FIG. 21 illustrates a cross sectional view of another mast embodiment.

An exemplary lift truck 5 includes an embodiment of a mast 10 having relatively narrow mast columns 15, for example, in a range of 13% to 33% narrower than commonly available mast columns for a lift truck with a similar lifting capacity. The mast columns 15 have a relatively small width in the lateral direction, that is, orthogonal to the longitudinal axis 20. For example, a three stage mast, such as mast 10, has a mast column 15 width in the range of 10 centimeters ("cm") to 13 cm, and preferably 11 cm (FIGS. 10 and 21). A two stage mast, such as mast 510 (FIG. 19), has a mast column 515 width in the range of 8 cm to 11 cm, and preferably 9.5 cm.

The lift truck 5 has a body 25 that includes an operator's compartment 30 and a front portion 35 that is between the mast 10 and the operator's compartment 30. Mast 10, and other suitable masts as defined by the claims, may be included on other types of lift trucks or on other suitable vehicles.

Figure 1:
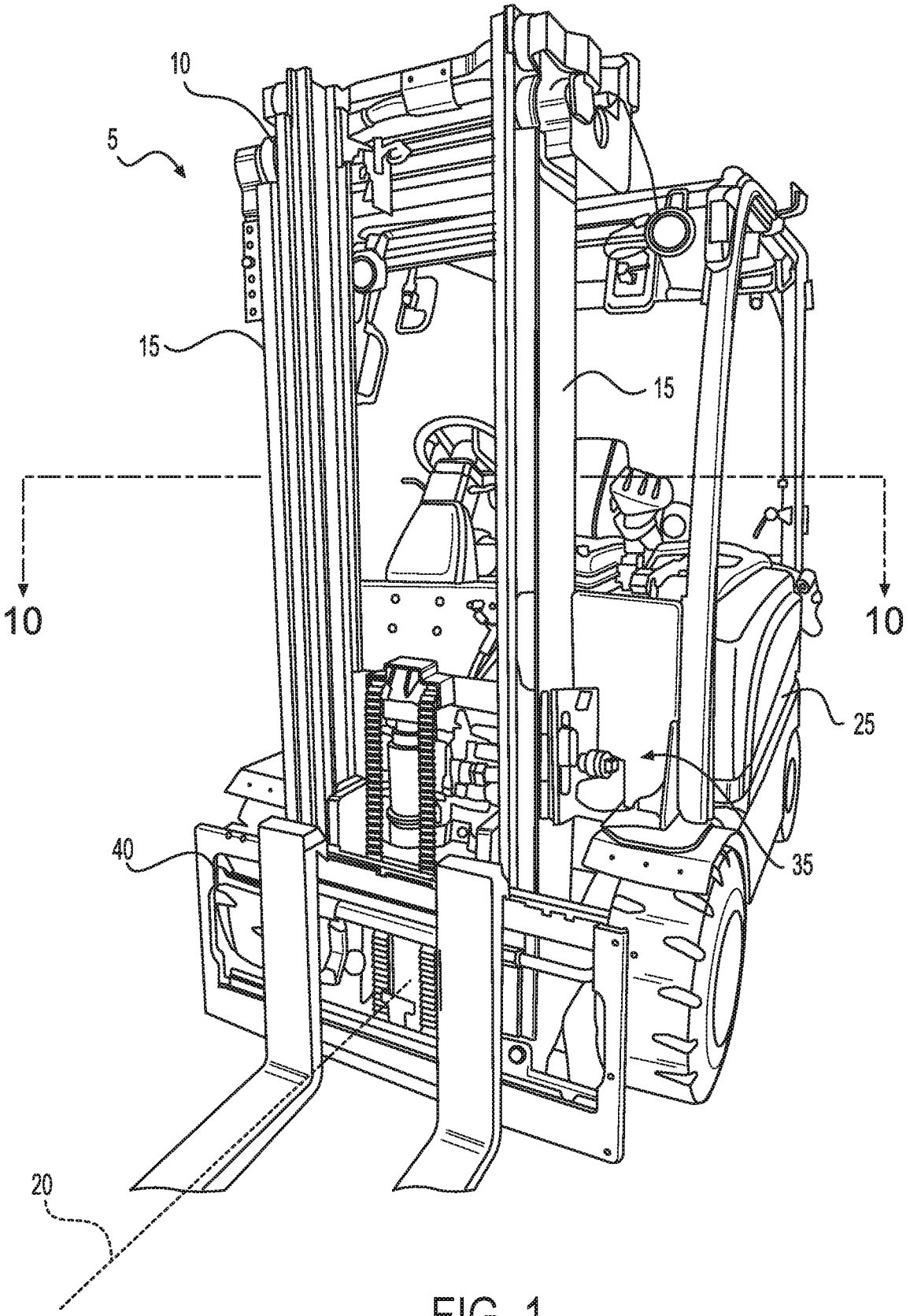
FIG. 1 illustrates an orthogonal view of a fork lift truck with an exemplary mast.
Figure 2:
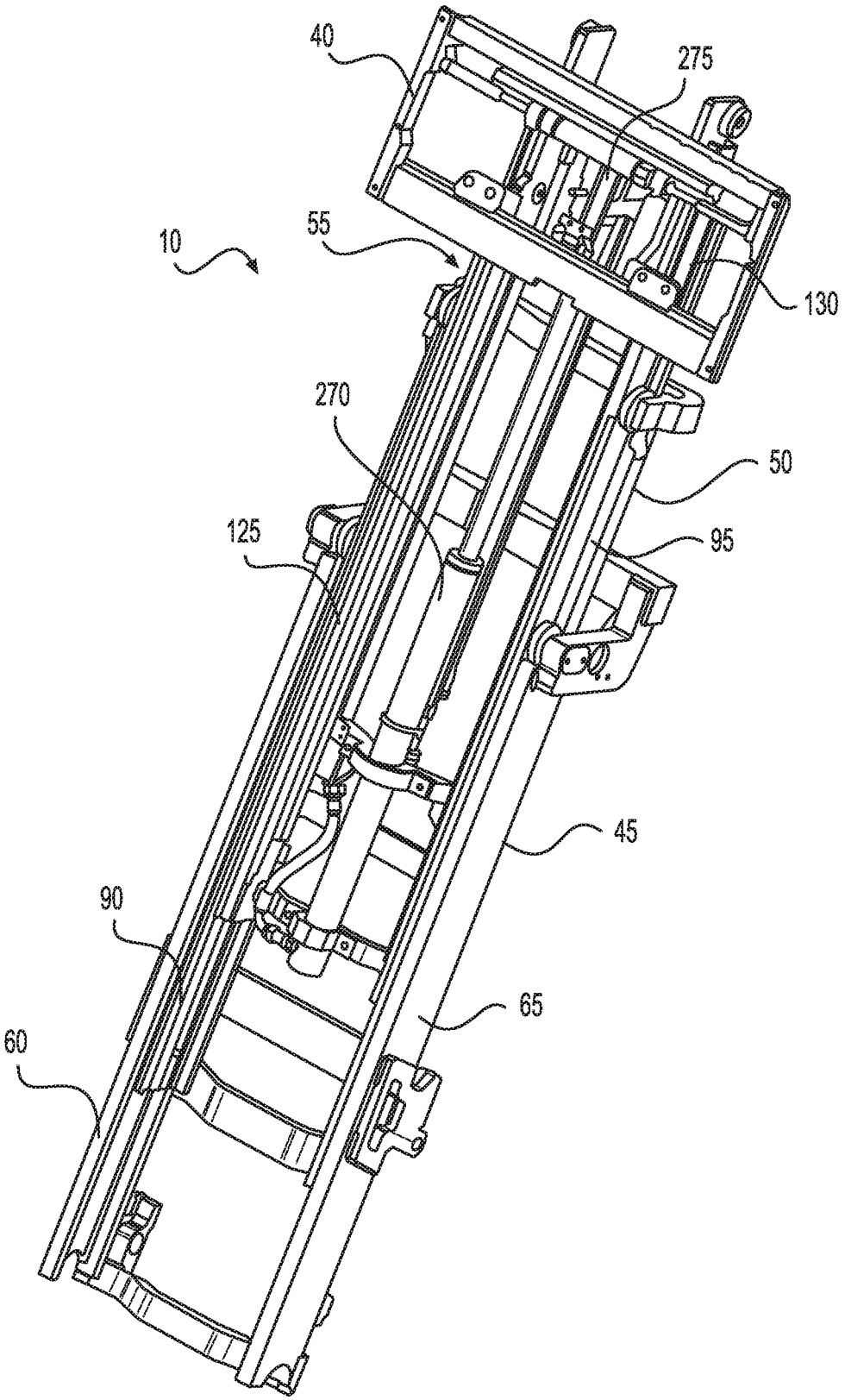
FIG. 2 illustrates a front orthogonal view of the mast of FIG. 1.
Figure 3:
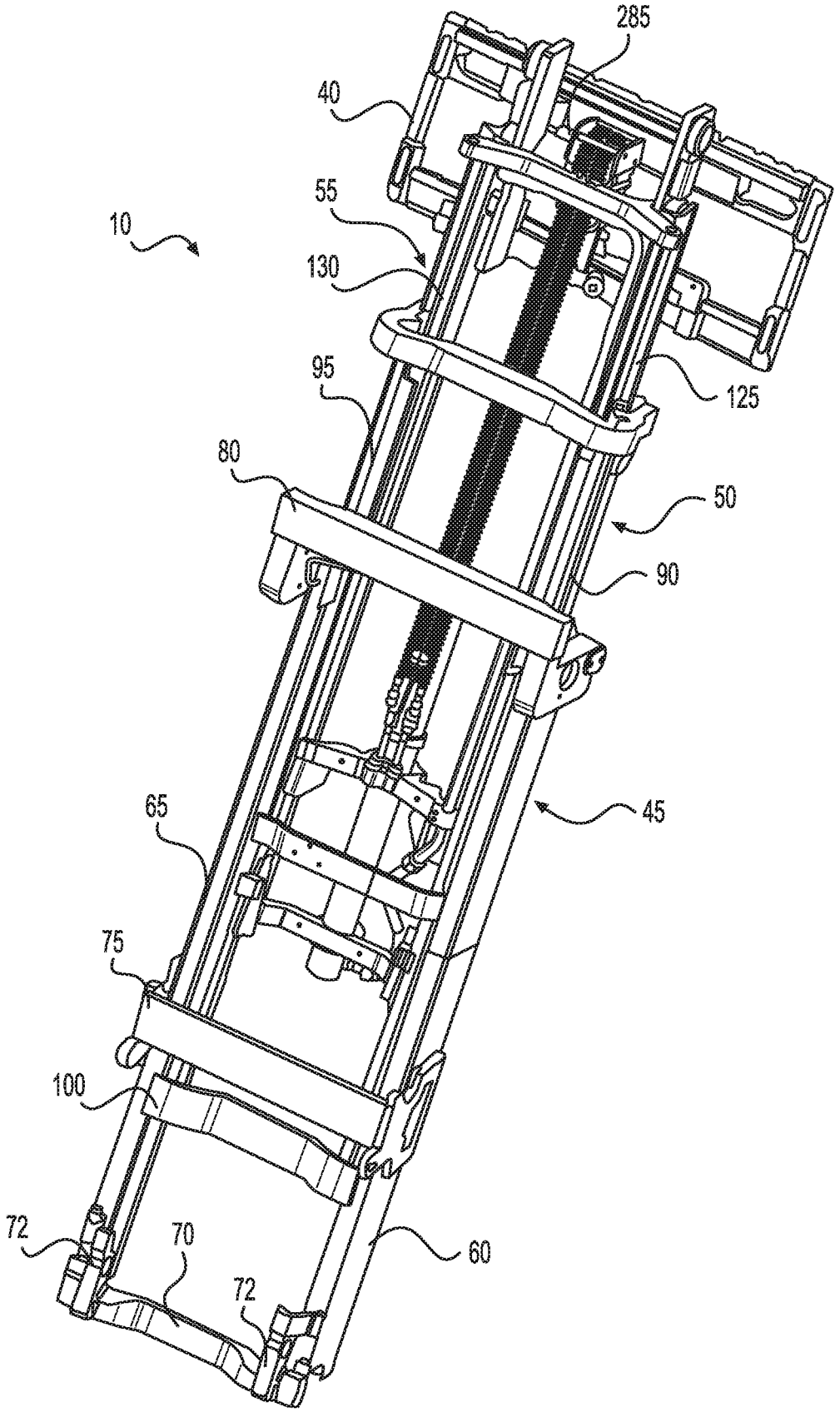
FIG. 3 illustrates a rear orthogonal view of the mast of FIG. 1, but with the main cylinders removed for clarity.

The mast 10 connects to the front portion 35 of the lift truck 5 and extends in a generally vertical direction. The mast 10 supports a fork carriage 40 that is raised to different heights by the mast 10 by movement of the mast sections as described below. The mast 10 is comprised of three sections that telescope with respect to each other as illustrated in FIGS. 2 and 3. The sections are a base section 45, a middle section 50, and an inner section 55. Rollers mounted to and between the sections 45, 50 and 55 enable such sections to slide, or telescope, with respect to each other, as described in detail below. For all of the rollers described below, other sliding engagement supports, for example, ball bearing sets or a pad of low friction material made from high-density polyethylene, ultra-high molecular weight polyethylene, or other suitable material, may be used in place of rollers.

Figure 4:
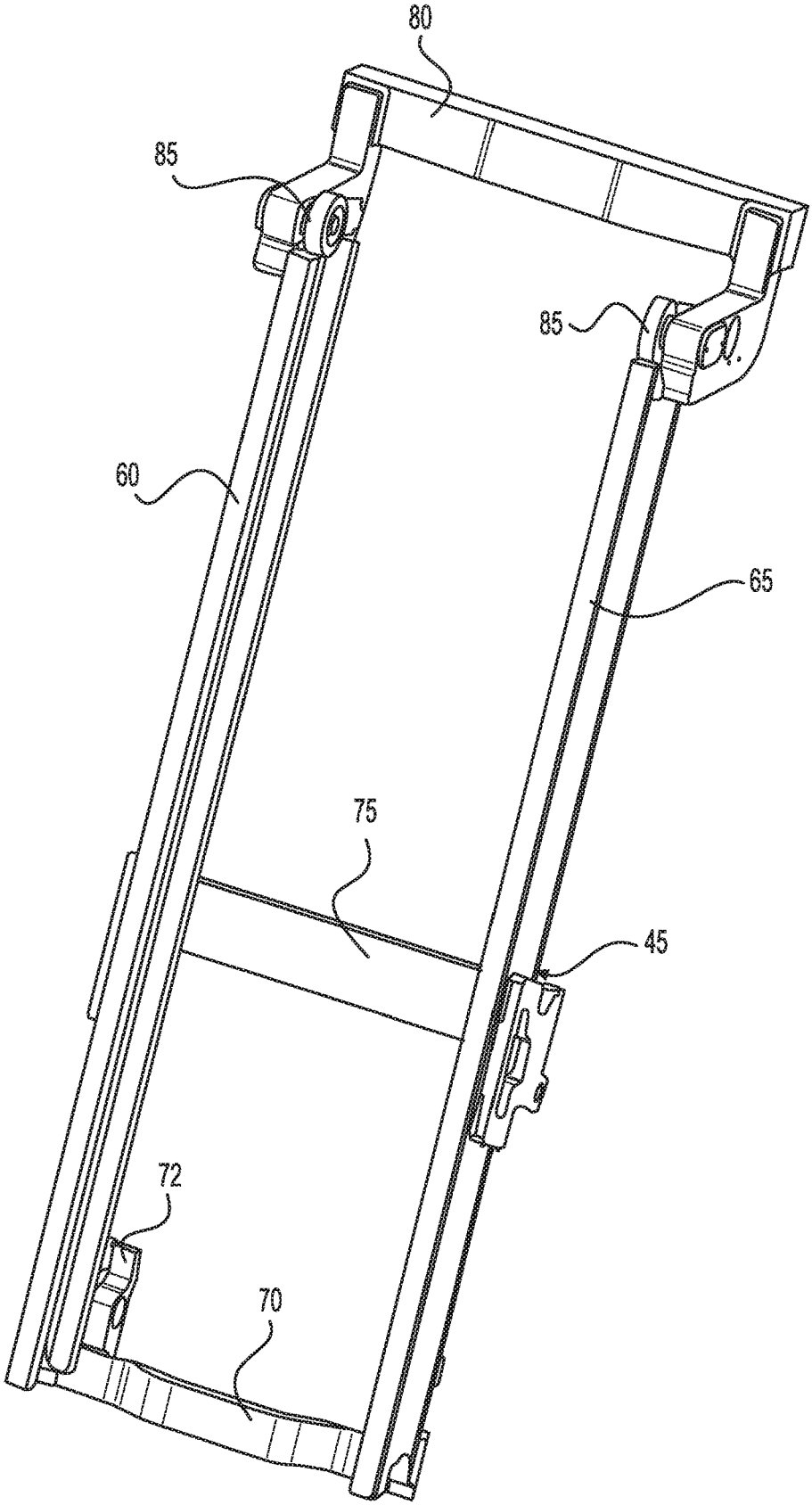
FIG. 4 illustrates a front orthogonal view of the base section of the mast of FIG. 1.

The base section 45 (FIG. 4) comprises a pair of base rails 60 and 65 connected at their lower ends by a lower crosstie 70, between their lower ends and upper ends by a mid-crosstie 75, and at their upper ends by an upper crosstie 80. The lower crosstie 70 attaches to the front portion 35 of the lift truck 5 to fasten the mast 10 to the lift truck 5, for example, via attachment points 72 (both illustrated in FIG. 3). Crossties 70, 75, and 80 help to maintain the base rails 60 and 65 in parallel alignment with each other.

Figure 5:
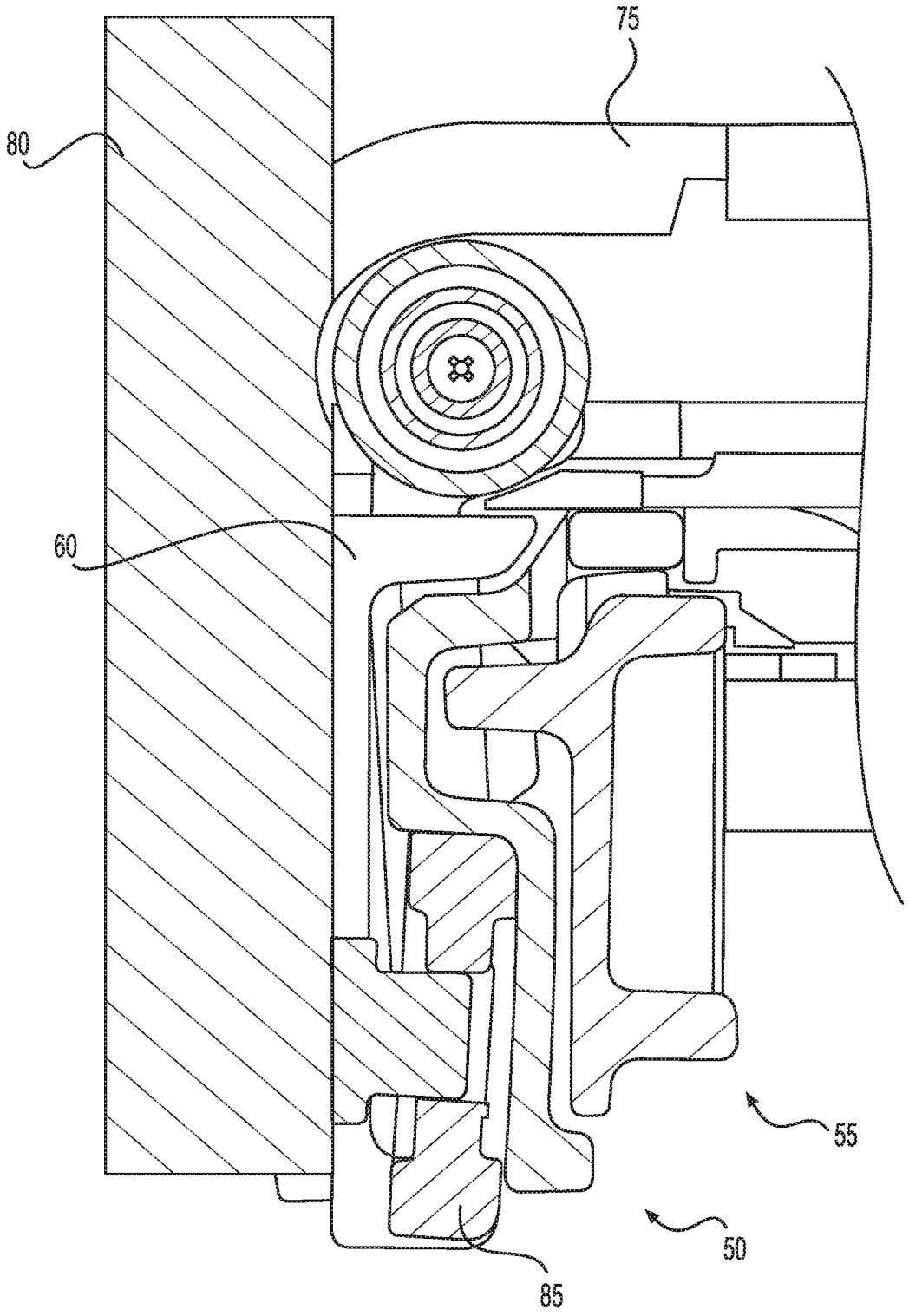
FIG. 5 illustrates a top sectional view of the right mast column of the mast of FIG. 1 taken along sectional line 5-5 (FIG. 12).

Base rollers 85 are secured to the upper crosstie 80 and each engage a substantially flat surface of the middle section 50 (best illustrated in FIG. 5). Base rollers 85 reduce contact between the base section 45 and the middle section 50 (for example, compared to not having base rollers 85) and enable a relatively low friction interaction between the base section 45 and the middle section 50 because of the rotational movement of the base rollers 85.

Figure 6:
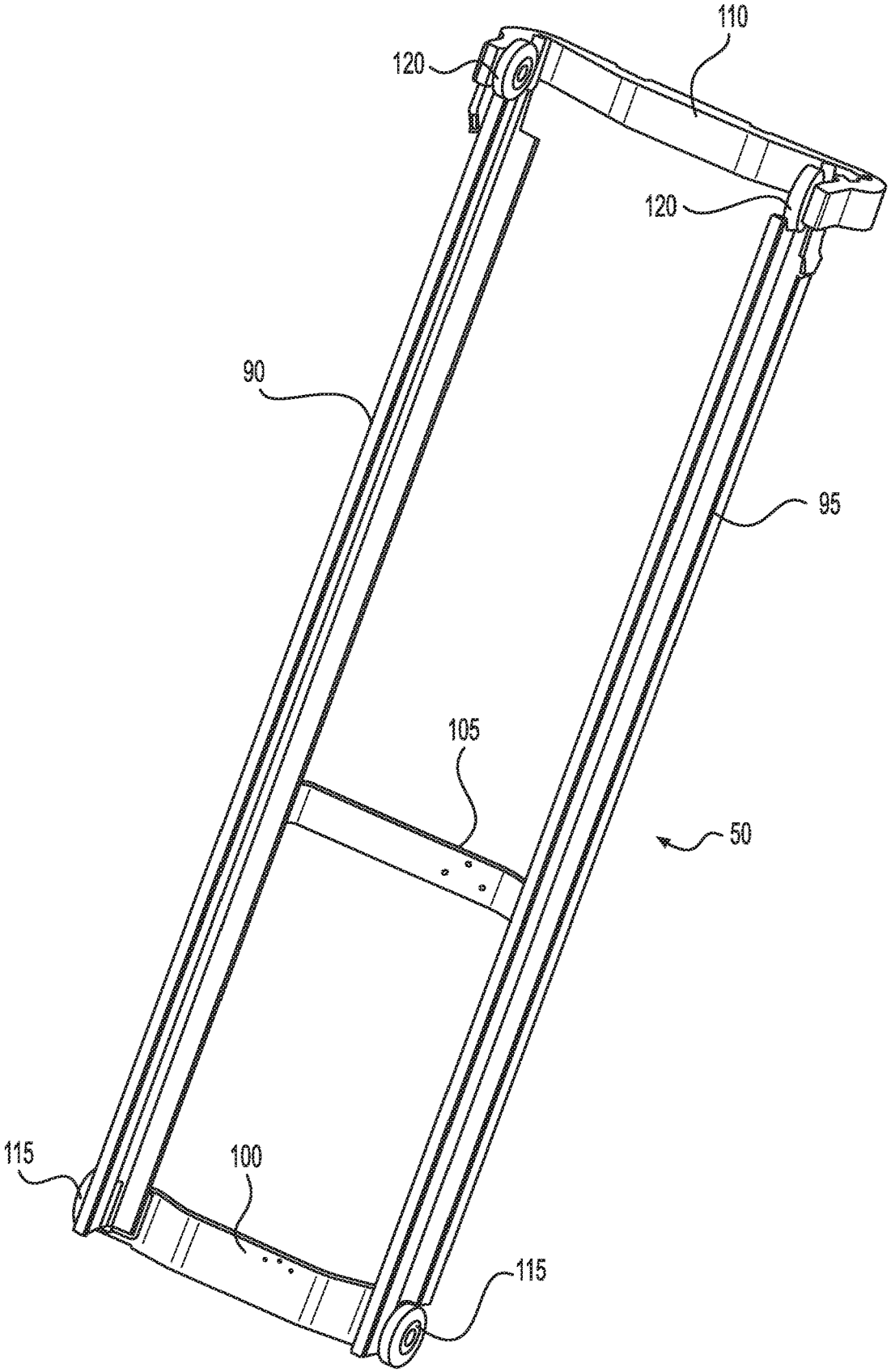
FIG. 6 illustrates a front orthogonal view of the middle section of the mast of FIG. 1.

The middle section 50 (FIG. 6) comprises a pair of middle rails 90 and 95 connected at their lower ends by a lower crosstie 100, between their lower ends and upper ends by a mid-crosstie 105, and at their upper ends by an upper crosstie 110. Crossties 100, 105, and 110 help to maintain the middle rails 90 and 95 in parallel alignment with each other.

Figure 7:
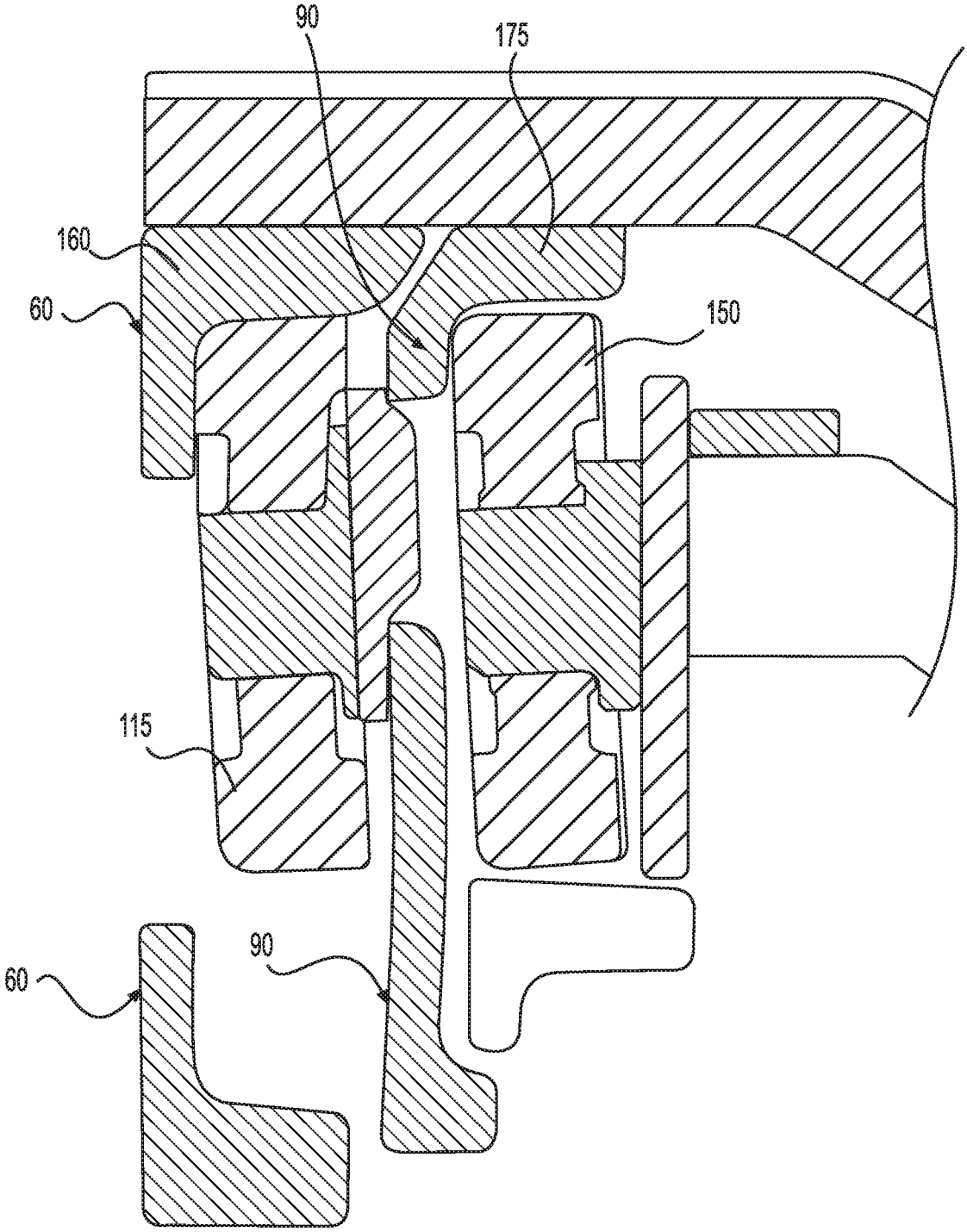
FIG. 7 illustrates a top sectional view of the right mast column of the mast of FIG. 1 taken along sectional line 7-7 (FIG. 12).

Middle, lower rollers 115 are secured to the lower crosstie 100 and each engage a substantially flat surface of the base section 45, for example, the forward-facing surface of rear flange 160 of base rail 60 (FIG. 7). Middle, lower rollers 115 reduce contact between the middle section 50 and the base section 45 (for example, compared to not having rollers 115) and enable a relatively low friction interaction between the base section 45 and the middle section 50 because of the rotational movement of the middle, lower rollers 115.

Figure 8:
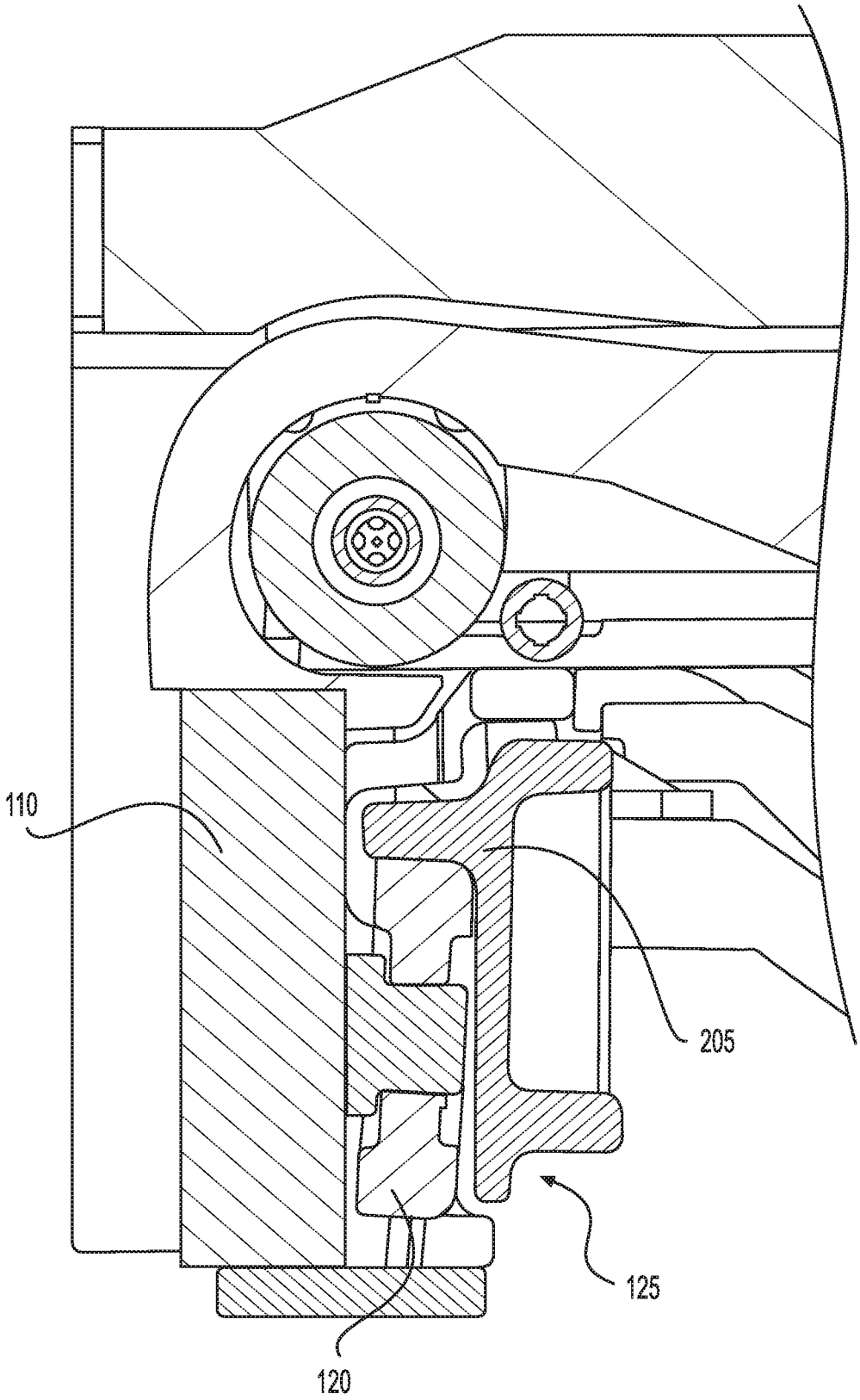
FIG. 8 illustrates a top sectional view of the right mast column of the mast of FIG. 1 taken along sectional line 8-8 (FIG. 12).

Middle, upper rollers 120 are secured to the upper crosstie 110 and each engage a substantially flat surface of the inner section 55, for example, the forward-facing surface of projecting portion 205 of inner rail 125 (FIG. 8). Middle, upper rollers 120 reduce contact between the middle section 50 and the inner section 55 (for example, compared to not having rollers 120) and enable a relatively low friction interaction between the middle section 50 and the inner section 55 because of the rotational movement of the middle, upper rollers 120.

The inner section 55 (FIG. 9) comprises a pair of inner rails 125 and 130 connected at their lower ends by a lower crosstie 135, between their lower ends and upper ends by a mid-crosstie 140, and at their upper ends by an upper crosstie 145. Crossties 135, 140, and 145 help to maintain the inner rails 125 and 130 in parallel alignment with each other.

Figure 9:
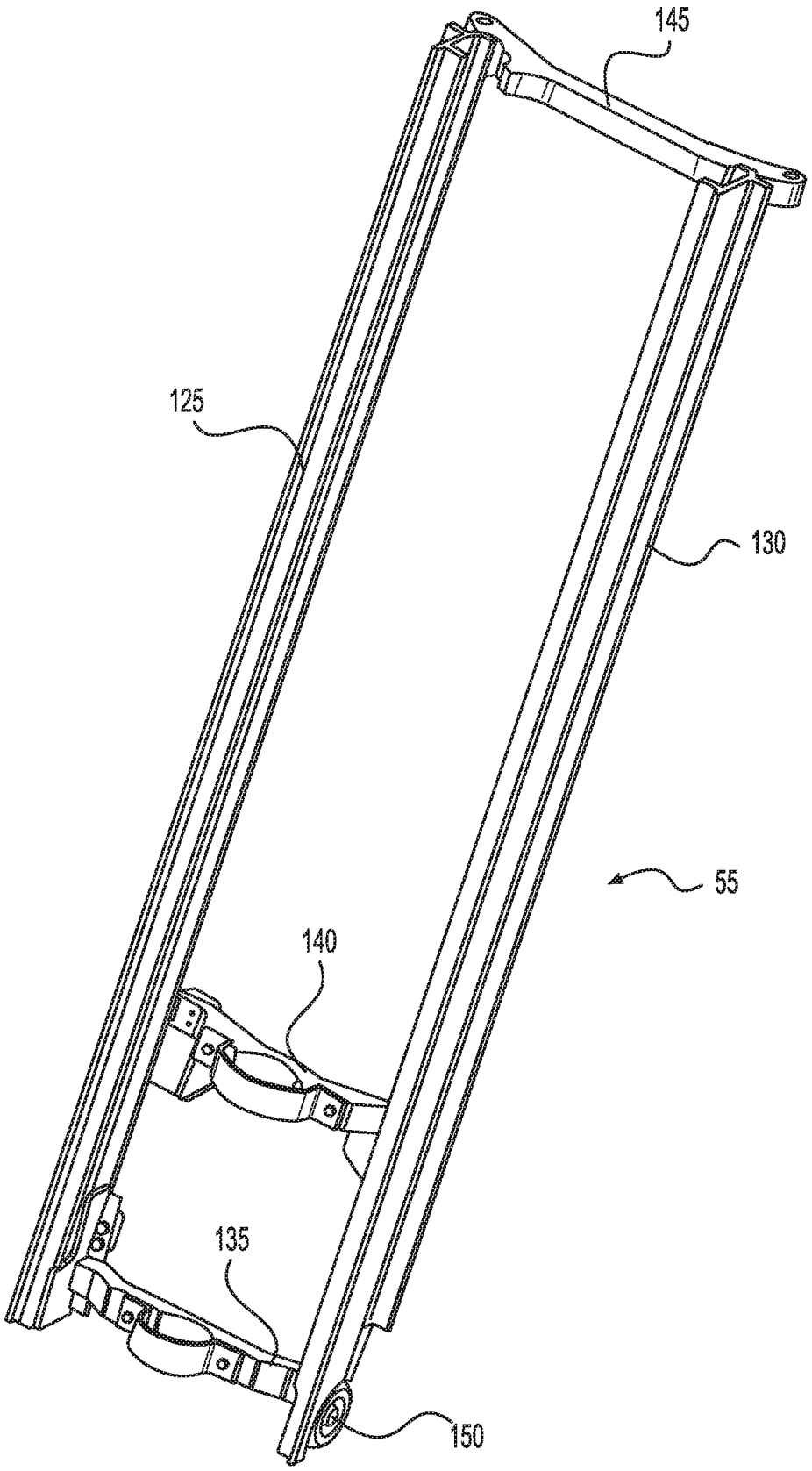
FIG. 9 illustrates a front orthogonal view of the inner section of the mast of FIG. 1.

Inner, lower rollers 150 (only one inner, lower roller 150 associated with inner rail 130 is illustrated in FIG. 9, but another inner, lower roller 150 is also associated with inner rail 125) are secured to the lower crosstie 135 and each engage a substantially flat surface of the middle section 50, for example, the forward-facing surface of the tail piece 175 of middle rail 90 (FIG. 7). Inner, lower rollers 150 reduce contact between the inner section 55 and the middle section 50 (for example, compared to not having rollers 150) and enable a relatively low friction interaction between the middle section 50 and the inner section 55 because of the rotational movement of the inner, lower rollers 150.

Additional crossties may be used with any one, any two, or all of the base section 45, middle section 50, and inner section 55.

Viewed from the top of a lift truck, such as lift truck 5, FIG. 10 illustrates the shape and positioning of the right-side rails 60, 90, and 125 that make up one mast column 15. Base rail 60 is substantially ↄ-shaped (in other words, a reverse "C" shape) and includes a forward flange 155 and a rear flange 160 that are connected by a web 165. Forward flange 155 is distal from the front portion 35 of the lift truck 5, while rear flange 160 is proximate the front portion 35 of the lift truck 5.

The b-shaped middle rail 90 nests with the base rail 60. The b-shaped middle rail 90 comprises a forward flange 170 that is located proximate the forward flange 155 of the base rail 60 and a tail 175 that is substantially aligned with the rear flange 160 of the base rail 60. Forward flange 170 and tail 175 are connected by a curved web 180. Curved web 180 includes a bulbous portion 185. The bulbous portion 185 extends towards web 165 of the base rail 60 and is located proximate the rear flange 160 of the base rail 60.

The ↄ-shaped (in other words, reverse "c" shape) inner rail 125 nests with the b-shaped middle rail 90. The ↄ-shaped inner rail 125 includes a forward flange 190 and a rear flange 195 connected by a web 200. Forward flange 190 is located proximate forward flange 170 of the middle rail 90 and rear flange 195 is located proximate the tail 175 of the middle rail 90 such that the inner rail 125 is contained between the forward flange 170 and the tail 175 of the middle rail 90. A projecting portion 205 extends from the web 200 into a channel created by the bulbous portion 185 of the middle rail 90.

Rails 65, 95, and 130 are identical to rails 60, 90, and 125, but are rotated by 180 degrees. That is, a top view of rails 65, 95, and 130 is a mirror image of what is illustrated in FIG. 10.

Figure 11:
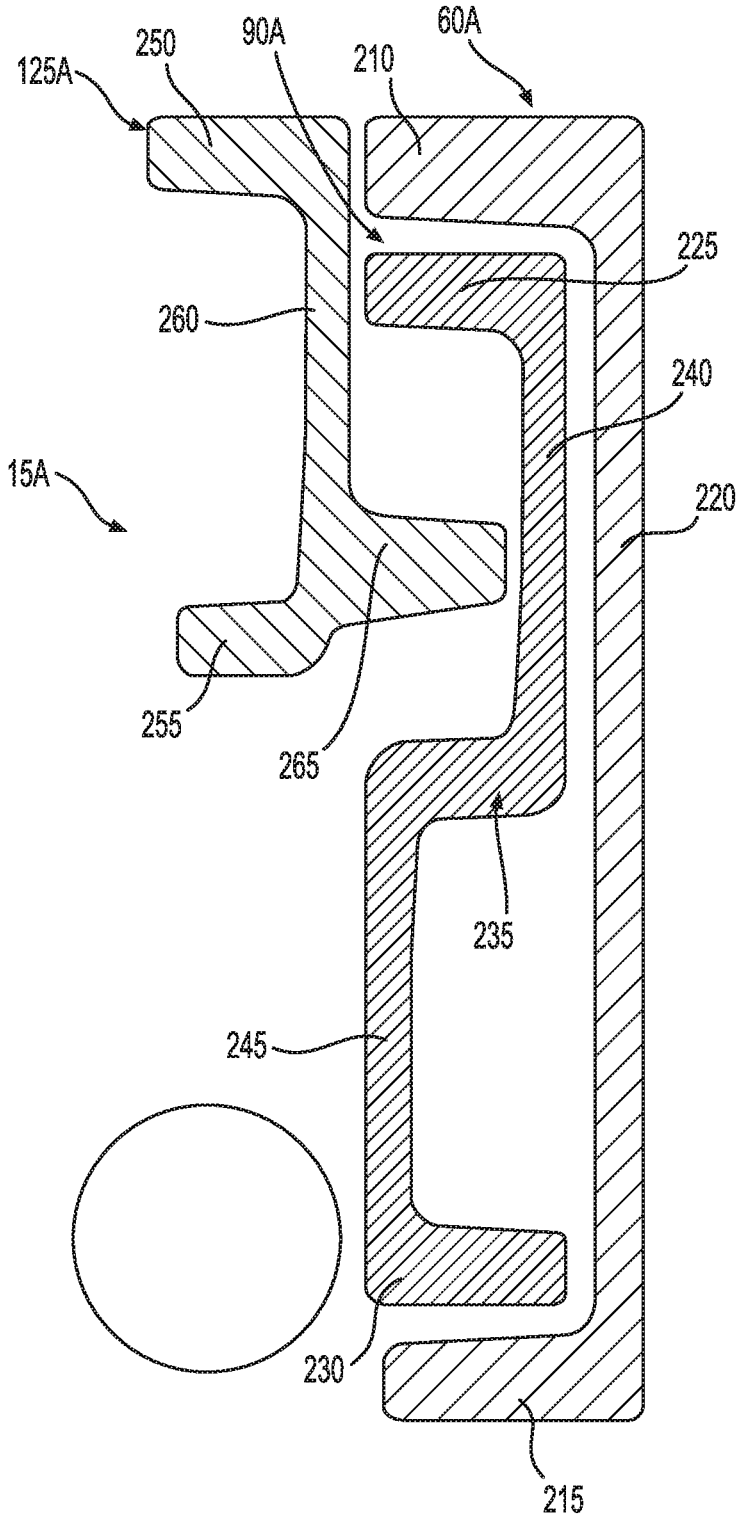
FIG. 11 illustrates a cross sectional view of another mast embodiment.

An alternate embodiment is illustrated in FIG. 11. Viewed from the top of a lift truck, such as lift truck 5, FIG. 11 illustrates the shape and positioning of the right-side rails 60A, 90A, and 125A that make up one mast column 15A. Base rail 60A is substantially reverse C-shaped and includes a forward flange 210 and a rear flange 215 that are connected by a web 220. Forward flange 210 is distal from the front portion 35 of the lift truck 5 while rear flange 215 is proximate the front portion 35. An upper roller, or other suitable device, is located proximate the rear flange 215 such that the roller engages a substantially flat surface of the middle rail 90A, for example, the rearward-facing surface of the central portion of the curved web 235. Such a roller reduces contact between the base rail 60A and the middle rail 90A (for example, compared to not having a roller) and enables a relatively low friction interaction between the base rail 60A and the middle rail 90A.

The reverse S-shaped middle rail 90A nests with the base rail 60A. The reverse S-shaped middle rail 90A comprises a forward flange 225 that is located proximate the forward flange 210 of the base rail 60A and a rear flange 230 that is proximate the rear flange 215 of the base rail 60A, but with the rear flange 215 of the base rail 60A between the front portion 35 of the lift truck 5 and the rear flange 230 of the middle rail 90A. Forward flange 225 and rear flange 230 are connected by a curved web 235. Curved web 235 includes a first curved portion 240 and a second curved portion 245. The first curved portion 240 extends towards web 220 of the base rail 60A while the second curved portion 245 extends away from web 220 of the base rail 60A. A lower roller, or other suitable device, is located in the channel created by the second curved portion 245 such that the roller engages a substantially flat surface of the base rail 60A, for example, the forward-facing surface of the rear flange 215. Such a roller reduces contact between the base rail 60A and the middle rail 90A (for example, compared to not having a roller) and enables a relatively low friction interaction between the base rail 60A and the middle rail 90A. An upper roller, or other suitable device, is located in the channel created by the first curved portion 240 such that the roller engages a substantially flat surface of the inner rail 125A, for example, the forward-facing surface of the rear flange projecting portion 265. Such a roller reduces contact between the middle rail 90A and the inner rail 125A (for example, compared to not having a roller) and enables a relatively low friction interaction between the middle rail 90A and the inner rail 125A.

The reverse c-shaped inner rail 125A nests with the reverse S-shaped middle rail 90A. The reverse c-shaped inner rail 125A includes a forward flange 250 and a rear flange 255 connected by a web 260. Forward flange 250 is substantially aligned with forward flange 210 of the base rail 60A. A projecting portion 265 extends from the web 260 into a channel created by the first curved portion 240 of the middle rail 90A. A lower roller, or other suitable device, is located proximate the projecting portion 265 such that the roller engages a substantially flat surface of the middle rail 90A, for example, the forward-facing surface of the central portion of the curved web 235. Such a roller reduces contact between the middle rail 90A and the inner rail 125A (for example, compared to not having a roller) and enables a relatively low friction interaction between the middle rail 90A and the inner rail 125A.

Rails that make up the opposing mast column 15A are identical to rails 60A, 90A, and 125A, but are rotated by 180 degrees. That is, a top view of the opposing mast column 15A is a mirror image of what is illustrated in FIG. 11.

In some embodiments, a conventional hydraulic cylinder and lift chain arrangement is used to move the fork carriage 40 with respect to the inner section 55, the inner section 55 with respect to the middle section 50, and the middle section 50 with respect to the base section 45. Such a conventional hydraulic cylinder and lift chain arrangement is well known in the art, and typically includes a free lift cylinder secured to the inner section 55 and centrally located between the mast columns with a lift chain running over the free lift cylinder having one end of the lift chain attached to the inner section 55 and the other end attached to the fork carriage 40. Two hydraulic cylinders, one located proximate each mast column and attached to the base section 45 are also included to move the inner section 55 and the middle section 50 with respect to the base section 45. Additional lift chains attached to the hydraulic cylinders and running over pulleys at the top of each of the hydraulic cylinders connect to the inner section 55, as is well known in the art. Additional structures (not shown) would need to be added to accommodate the lift chains associated with lifting the middle section 50 and the inner section 55.

Hydraulic System

Figure 12:
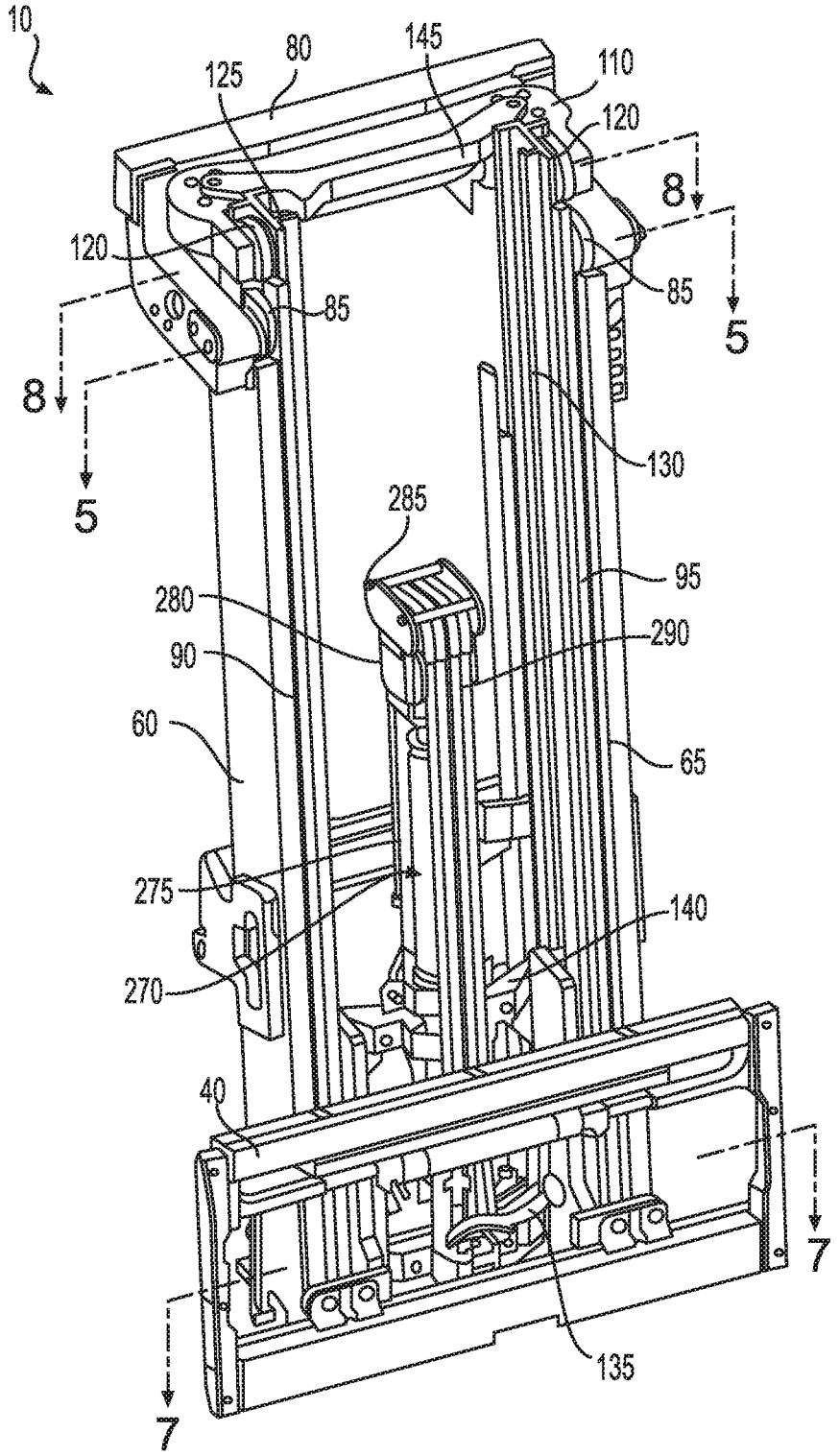
FIG. 12 illustrates a front orthogonal view of the mast of FIG. 1 in a collapsed condition.
Figure 13:
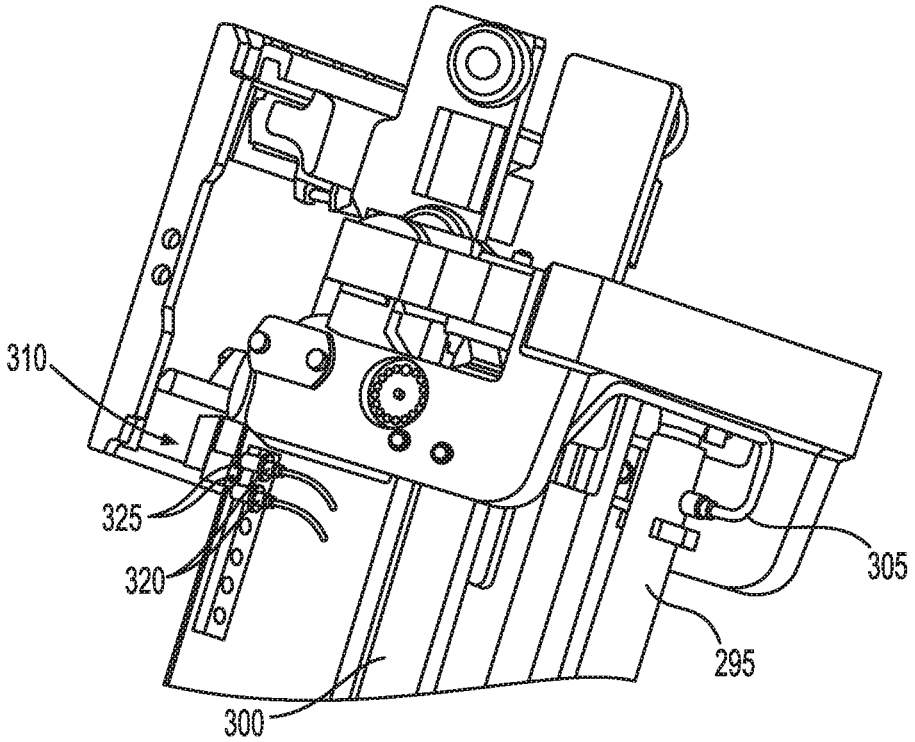
FIG. 13 illustrates a left, rear orthogonal close-up view of the mast of FIG. 1
Figure 14:
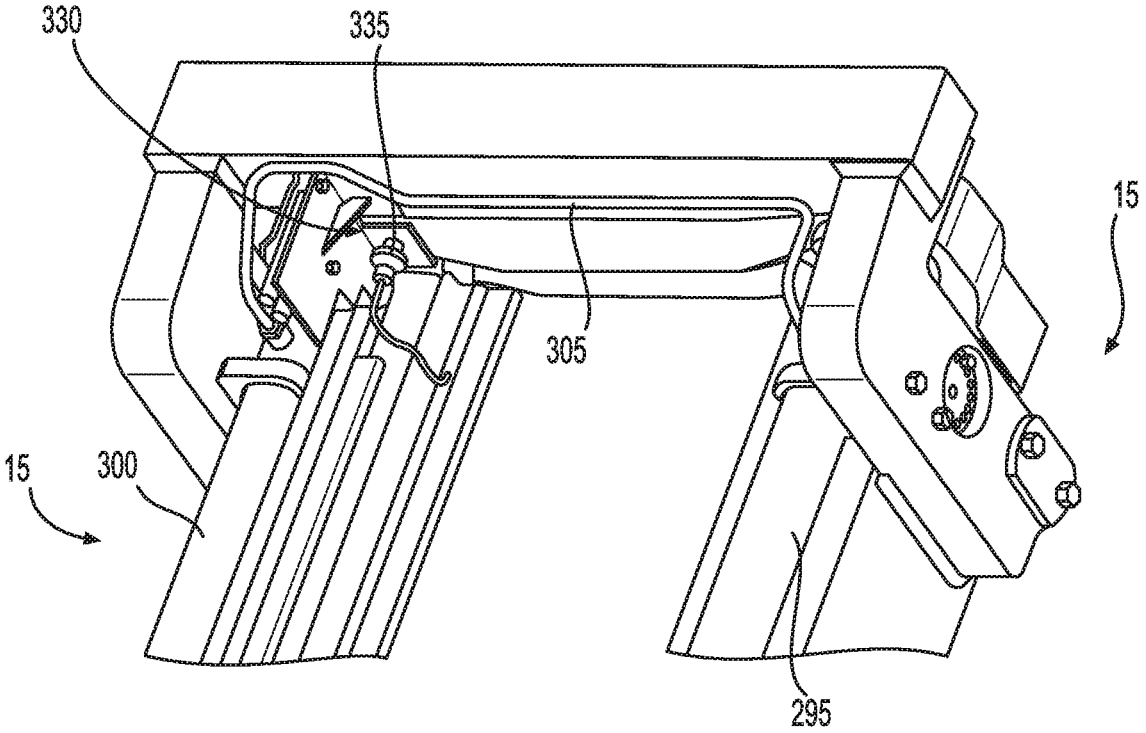
FIG. 14 illustrates a right, rear orthogonal close-up view of the top of the mast of FIG. 1.

In other embodiments a mast is lifted by a free lift cylinder 270 (FIG. 12) and two double acting hydraulic cylinders 295, 300 (FIGS. 13, 14) located proximate the mast columns 15. While the hydraulic system is described in connection with a mast, such as mast 10, the described embodiment of a hydraulic system, as well as other embodiments, may be used with conventional, currently existing masts. In an illustrated embodiment, a hydraulic cylinder 270 (FIG. 2) is secured to the mid-crosstie 140 and lower crosstie 135 of the inner section 55 to serve as a free lift cylinder for the carriage 40. Lift chains 275 (FIG. 2) are included on a roller 280 (FIG. 12) that is located beneath the roller 285 that holds the header hoses 290. Header hoses 290 are attached to the carriage 40 at one end and to the mid-crosstie 140 at the other end.

A feed-through, double acting hydraulic cylinder 295 (FIGS. 10 and 14) is secured to the base section 45 at a lower end, for example, to lower crosstie 70, and to the inner section 55 at an upper end, for example, to upper crosstie 145 proximate one of the mast columns 15. A double acting hydraulic lift cylinder 300 is secured to the base section 45 at a lower end, for example, to lower crosstie 70, and to the inner section 55 at an upper end, for example, to upper crosstie 145 proximate the other of the mast columns 15. A balance pipe 305 (FIGS. 13 and 14) hydraulically connects the feed-through, double acting hydraulic cylinder 295 with the double acting hydraulic lift cylinder 300. Balance pipe 305 may be a rigid pipe, a flexible tube or other suitable conduit for communicating hydraulic fluid.

Figure 17:
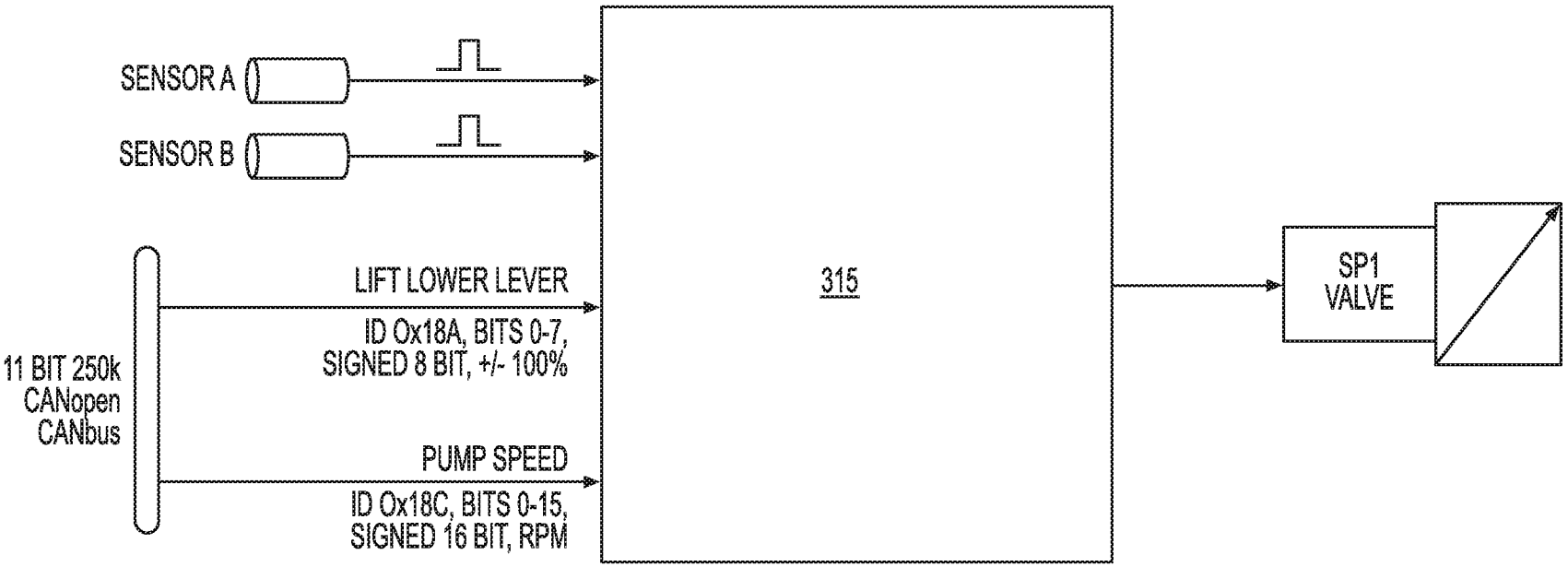
FIG. 17 illustrates an electrical schematic for the fork lift truck of FIG. 1.

A first sensor arrangement 310 (FIG. 13) provides a signal to a controller 315 (FIG. 17) when the fork carriage 40 is within a range of 15 cm to 0 cm of its fully lifted position (0 cm representing the fully lifted position of the fork carriage 40). In the illustrated embodiment, the first sensor arrangement 310 comprises one or more inductive sensors 320 positioned on the base section 45 to detect one or more magnets 325 borne by the fork carriage 40 as the fork carriage 40 approaches and enters its fully lifted position. Other suitable sensors may be used.

A second sensor arrangement 330 (FIG. 14) provides a signal to the controller 315 when the middle section 50 is more than a predetermined distance from its resting location with respect to the base section 45, preferably more than 1 cm. In the illustrated embodiment, the second sensor arrangement 330 comprises an inductive sensor 335 positioned on the upper crosstie 80 of the base section 45 and a magnet (not illustrated) borne by the upper crosstie 110 of the middle section 50. Other suitable sensors may be used.

Operation of the hydraulic circuit 340 is described with reference to the schematic diagram illustrated in FIG. 15. With the fork carriage 40 at its lowered position (FIG. 12) proportional valve 345 is in an off position such that there is no hydraulic communication between the hydraulic line 350 and the pump 355 or the tank 360. Thus, the hydraulic pressures in hydraulic line 350, hydraulic line 365, feed-through, double acting cylinder 295, hydraulic line 375, free lift cylinder 270, balance pipe 305, double acting lift cylinder 300, hydraulic line 380, hydraulic line 390, and hydraulic line 405 are the same, or substantially the same, such as within 30 bar of one another, when there is no hydraulic communication between the hydraulic line 350 and the pump 355 or the tank 360. A check valve 395, here illustrated as part of valve 400, prevents hydraulic communication between hydraulic line 390 and hydraulic line 405.

Figure 18:
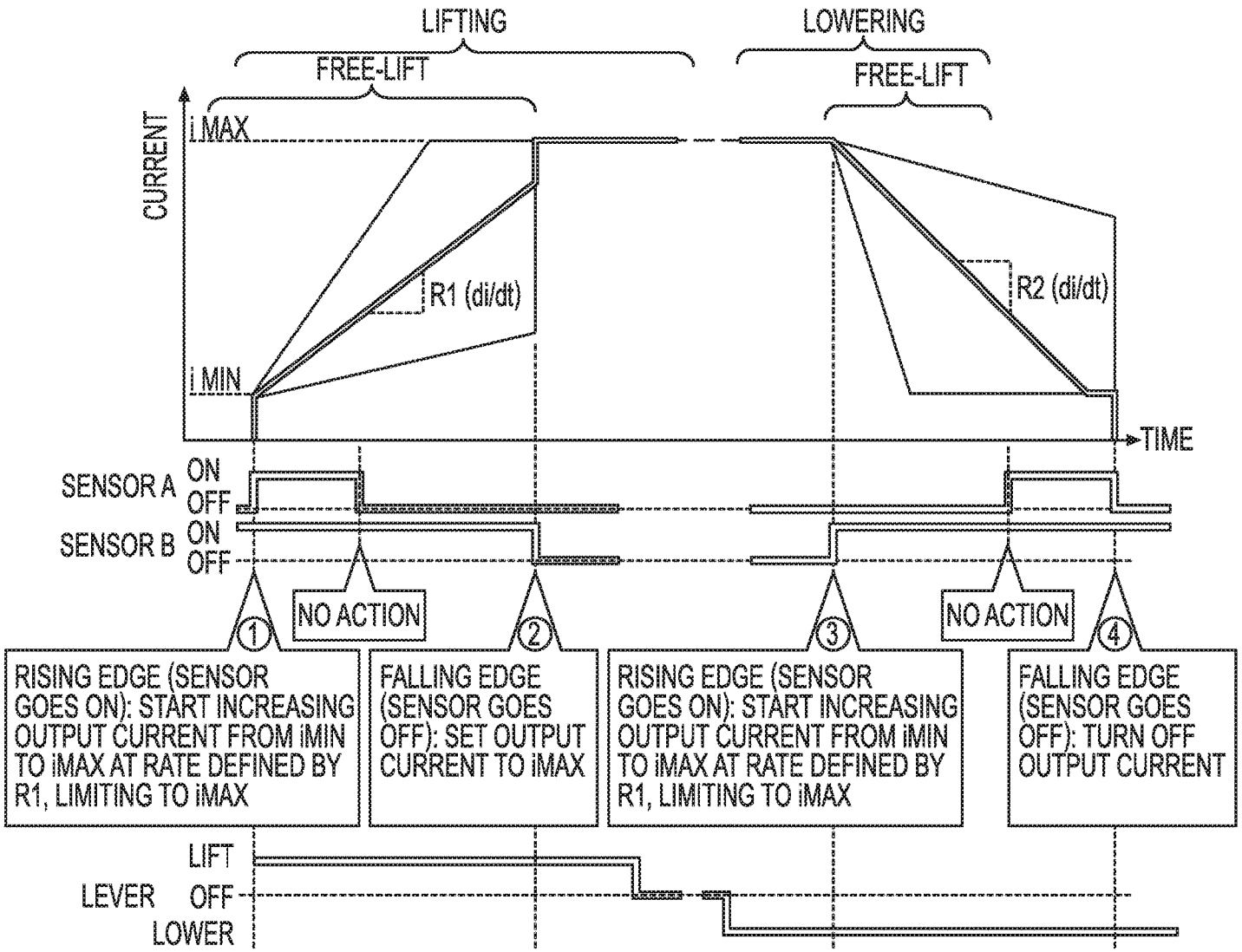
FIG. 18 illustrates an illustrative ramping profile for operating portions of a hydraulic circuit.

When a lift command is received by the controller 315 and the fork carriage 40 is at its lowered position, the pump 355 is commanded to increase pressure and the proportional valve 345 is opened by the controller 315. For example, valve 345 may be ramped open according to a profile such as illustrated in the free-lift portion of the lifting cycle illustrated in FIG. 18. Other ramping profiles may be used and in some embodiments the valve 345 may be fully opened as quickly as possible. As proportional valve 345 is opened pressure builds in hydraulic line 350, hydraulic line 365, feed-through, double acting cylinder 295, hydraulic line 375, free lift cylinder 270, balance pipe 305, double acting lift cylinder 300, and hydraulic line 405. Check valve 395 continues to prevent hydraulic communication between hydraulic line 390 and hydraulic line 405.

Hydraulic oil flow through the feed-through, double acting cylinder 295 to the free lift cylinder 270 is discussed with reference to FIGS. 15 and 16. When inner cylinder 420 and intermediate cylinder 430 are at their lowermost position, check valve 415 is mechanically held open, for example, via contact with shelf 416. Hydraulic oil enters feed-through, double acting cylinder 295 through port 410 and line burst valve 411 and flows through check valve 415 into inner cylinder 420 and out port 425 and line burst valve 426 to hydraulic line 375. Pressures are equalized, or nearly equalized, for example, within a differential of 30 bar, among hydraulic line 350, hydraulic line 365, feed-through, double acting cylinder 295, hydraulic line 375, free lift cylinder 270, balance pipe 305, double acting lift cylinder 300, and hydraulic line 405, (FIG. 15) primarily via ports 421, 431 in the inner cylinder 420 and intermediate cylinder 430, respectively, of the feed-through, double acting cylinder 295, the balance pipe 305, and ports 436, 441 in the inner cylinder 435 and the intermediate cylinder 440, respectively, of the double acting lift cylinder 300. At some point the pressure in hydraulic line 350, hydraulic line 365, feed-through, double acting cylinder 295, hydraulic line 375, free lift cylinder 270, balance pipe 305, and double acting cylinder 300 becomes great enough to lift a load borne by the fork carriage 40 and hydraulic oil flows through port 425 to the free lift cylinder 270 which expands causing the fork carriage 40 to travel up the inner section 55 towards the fully lifted position of the fork carriage 40.

When (1) the first sensor arrangement 310 (FIG. 13) sends a signal to the controller 315 indicating that the fork carriage 40 is within a range of 15 cm to 0 cm of its fully lifted position, and preferably at its fully lifted position, (2) a lift command is received by the controller 315, and (3) the second sensor arrangement 330 sends a signal indicating that the middle section 50 is within a predetermined distance from its resting location with respect to the base section 45, for example, within a range of 0 cm to 1 cm, the controller 315 causes the valve 400 to open, or partially open, to facilitate balancing a pressure increase in both of the feed-through, double acting cylinder 295 and the double acting lift cylinder 300. Valve 400 may be a proportional valve, a two-position valve, or other suitable valve. Pressurized fluid is thus supplied to double acting lift cylinder 300 via the pump 355 through hydraulic line 405, valve 400, hydraulic line 390 and port 475 while pump 355 continues to provide pressurized fluid to the feed-through, double acting cylinder 295.

Figure 16:
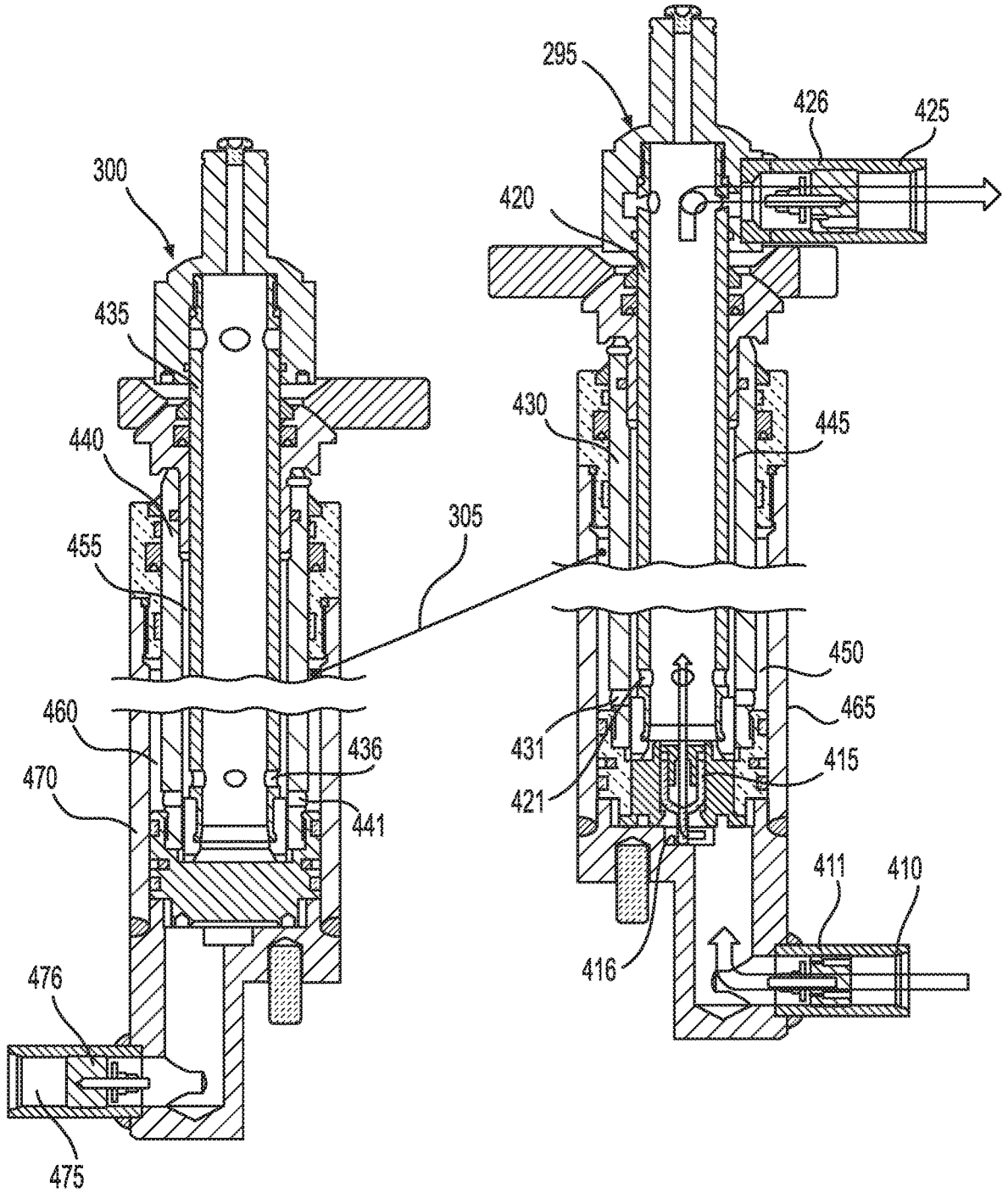
FIG. 16 illustrates a partial cross sectional view of the feed-through cylinder and the lift cylinder for the mast of FIG. 1 with the balance pipe 305 schematically illustrated.

Because free lift cylinder 270 cannot extend further, hydraulic pressure builds within the feed-through, double acting cylinder 295 causing inner cylinder 420 to move with respect to intermediate cylinder 430, and intermediate cylinder 430 to move with respect to outer cylinder 465 due to fluid transfer from annulus 450 through ports 431 into annulus 445 (FIG. 16). Check valve 415 is held closed because pressure in annulus 450 is greater than the pressure of the hydraulic fluid supplied by pump 355. Likewise, inner cylinder 435 and intermediate cylinder 440 of the double acting lift cylinder 300 extend due to pressurized fluid transfer from annulus 460 through ports 441 into annulus 455. Balance pipe 305 facilitates both the feed-through, double acting cylinder 295 and the double acting lift cylinder 300 operating at the same, or a matching, hydraulic pressure, for example, to hinder the mast 5 from lozenging, in other words, from leaning to one side outside of an acceptable amount of leaning for a lift truck mast. In a preferred embodiment, the amount of lozenging is less than 25 mm, although those skilled in the art will recognize that typical lozenging values are dependent on lift height.

For the illustrated embodiment, the surface area upon which hydraulic fluid acts to move the inner cylinder 420 is within a range of 0.8 to 1.2 of the surface area upon which hydraulic fluid acts to move the intermediate cylinder 430, and preferably the two surface areas are the same (as determined within manufacturing tolerances). Likewise, the surface area upon which hydraulic fluid acts to move the inner cylinder 435 is within a range of 0.8 to 1.2 of the surface area upon which hydraulic fluid acts to move the intermediate cylinder 440, and preferably the two surface areas are the same (as determined within manufacturing tolerances).

By controlling the ratios of the surface areas upon which hydraulic fluid acts to move the inner cylinder 420, intermediate cylinder 430, inner cylinder 435, and the intermediate cylinder 440 and the opening pressure for check valve 415, the rate of movement of the inner cylinder 420 with respect to the intermediate cylinder 430 of the feed-through, double acting cylinder 295 is within a range of + or −20% of the rate of movement of the inner cylinder 435 with respect to the intermediate cylinder 440 of the double acting lift cylinder 300. Likewise, the rate of movement of the inner cylinder 420 with respect to the intermediate cylinder 430 of the feed-through, double acting cylinder 295 is within a range of + or −20% of the rate of movement of the intermediate cylinder 430 with respect to the outer cylinder 465 of the feed-through, double acting cylinder 295, which in turn is within a range of + or −20% of the rate of movement of the intermediate cylinder 440 with respect to the outer cylinder 470 of the double acting cylinder 300. In other words, the rates of extension of the inner cylinder 420, the intermediate cylinder 430, the inner cylinder 435, and the intermediate cylinder 440 are matched such that the mast 5 extends without one mast column 15 racing or lagging the other mast column 15 to a degree that is not acceptable within the materials handling industry.

The inner cylinder 420 and the inner cylinder 435 are secured to the upper crosstie 145 of the inner section 55. The intermediate cylinder 430 and the intermediate cylinder 440 are secured to the upper crosstie 110 of the middle section 50. Thus, the middle section 50 and the inner section 55 are both simultaneously raised at approximately the same rate.

Optional pressure sensors 370 and 385 may be included for hydraulic circuit 340 to provide pressure information to controller 315. For example, such pressure information may be used by controller 315 when controlling proportional valve 345 to ramp open or closed when lifting or lowering the carriage 40 via free lift cylinder 270. If pressure sensors 370 and 385 are omitted, hydraulic lines 365 and 380 may also be omitted.

In other embodiments, the rate of extension of the inner cylinder 420 and the inner cylinder 435 is matched, and the rate of extension of the intermediate cylinder 430 and the intermediate cylinder 440 is matched, but the rate of extension of the inner cylinder 420 and the inner cylinder 435 is different from the rate of extension of the intermediate cylinder 430 and the intermediate cylinder 440.

When the controller 315 no longer receives a lift command, the controller 315 causes the proportional valve 345 and the valve 400 to close and thus maintain pressure in hydraulic line 350, hydraulic line 365, feed-through, double acting cylinder 295, hydraulic line 375, free lift cylinder 270, balance pipe 305, double acting lift cylinder 300, hydraulic line 380, and hydraulic line 390 and thus hold the carriage 40, the middle section 50 and the inner section 55 at their current positions when the lift command ceased.

When the controller 315 receives a command to lower the mast 10, both the proportional valve 345 and valve 400 are opened and the middle section 50 and the inner section 55, if extended, drop towards their resting positions (FIG. 12) while the carriage 40 remains proximate the top of the inner section 55. After the middle section 50 and the inner section 55 reach their resting positions and the controller 315 receives a signal from sensor arrangement 330 that the middle section 50 is within a predetermined distance from its resting location with respect to the base section 45, the carriage 40 is lowered towards the bottom of the inner section 55 by the controller 315 operating the proportional valve 345. For example, the valve 400 may be fully closed and the proportional valve 345 may be commanded to close using a profile such as the free-lift lowering ramp illustrated in FIG. 18. Other suitable closing profiles may be used for the proportional valve 345.

If the controller 315 receives a lift command after receiving a lowering command, the controller 315 will check for signals from the sensor arrangements 310 and 330 to determine whether (i) the carriage 40 is within a predetermined distance of the top of the inner section 55 and (ii) whether the top of the middle section 50 is within a predetermined distance of the top of the base section 45. If the first sensor arrangement 310 indicates that the carriage 40 is not within a predetermined distance of the top of the base section 45 and the second sensor arrangement 330 sends a signal indicating that the middle section 50 is within a predetermined distance from its resting location with respect to the base section 45, the controller will lift the carriage 40 as described above. If the first sensor arrangement 310 sends a signal to the controller 315 indicating that the fork carriage 40 is within a predetermined distance of the top of the base section 45, for example, within a range of 15 cm to 0 cm of its fully lifted position, the controller 315 will lift the middle section 50 and the inner section 55 as described above. In other embodiments, if the second sensor arrangement 330 sends a signal indicating that the middle section 50 is not within a predetermined distance from its resting location with respect to the base section 45, the controller 315 will lift the middle section 50 and the inner section 55 as described above. In yet other embodiments, if (i) the first sensor arrangement 310 sends a signal to the controller 315 indicating that the fork carriage 40 is within a predetermined distance of the top of the base section 45 and (ii) the second sensor arrangement 330 sends a signal indicating that the middle section 50 is not within a predetermined distance from its resting location with respect to the base section 45, the controller 315 will lift the middle section 50 and the inner section 55 as described above. For sensor arrangements 310 and 330, as well as other suitable sensor arrangements, sending a signal includes the absence of an impulse. For example, second sensor arrangement 330 may send a signal to the controller 315 indicating that the fork carriage 40 is within a predetermined distance of the top of the base section 45 by transmitting an electrical or optical impulse to the controller 135 and may send a signal to the controller 315 indicating that the fork carriage 40 is not within a predetermined distance of the top of the base section 45 by not transmitting an electrical or optical impulse to the controller 315.

Two Stage Mast

Figure 19:
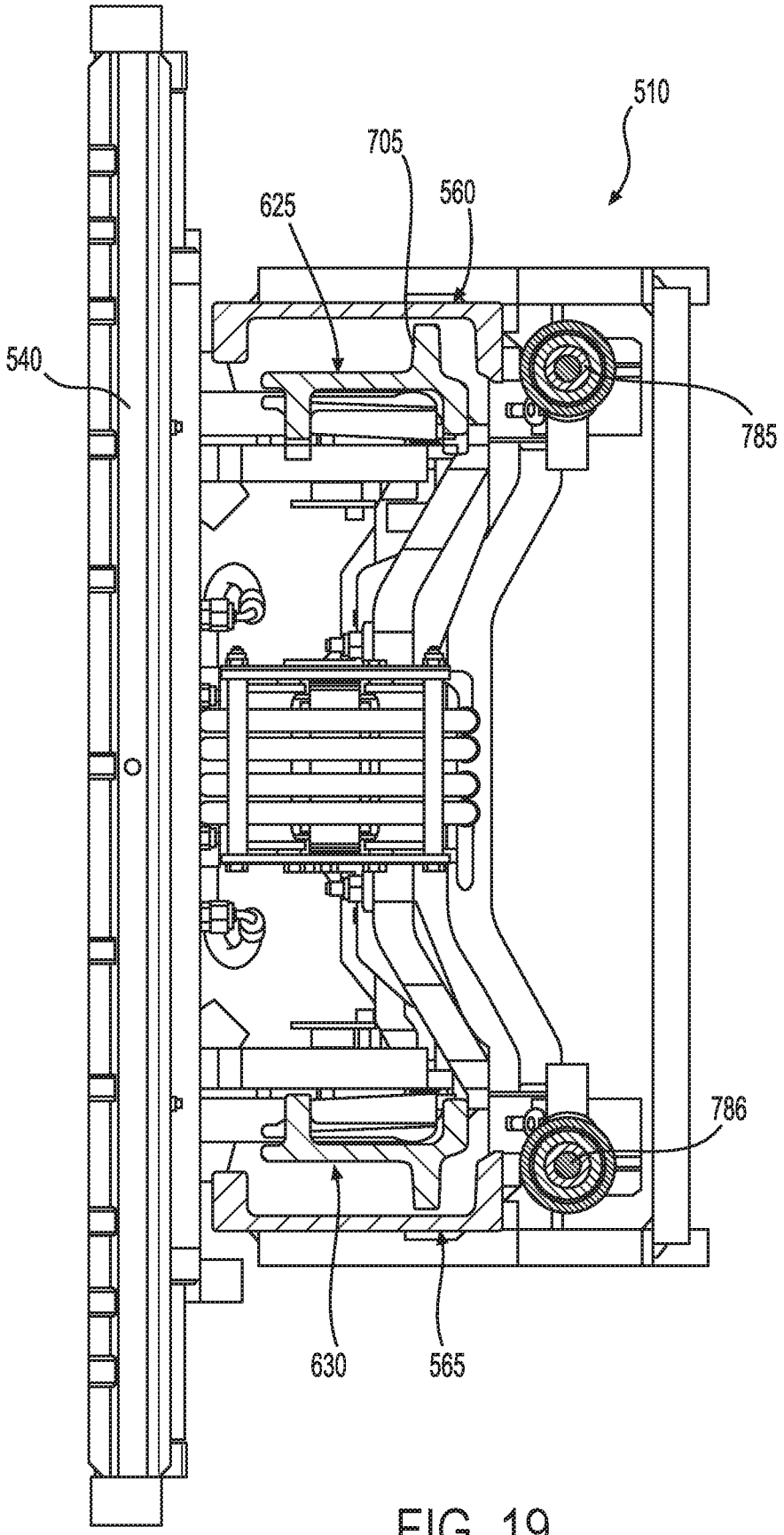
FIG. 19 illustrates a cross sectional view of another mast embodiment.
Figure 20:
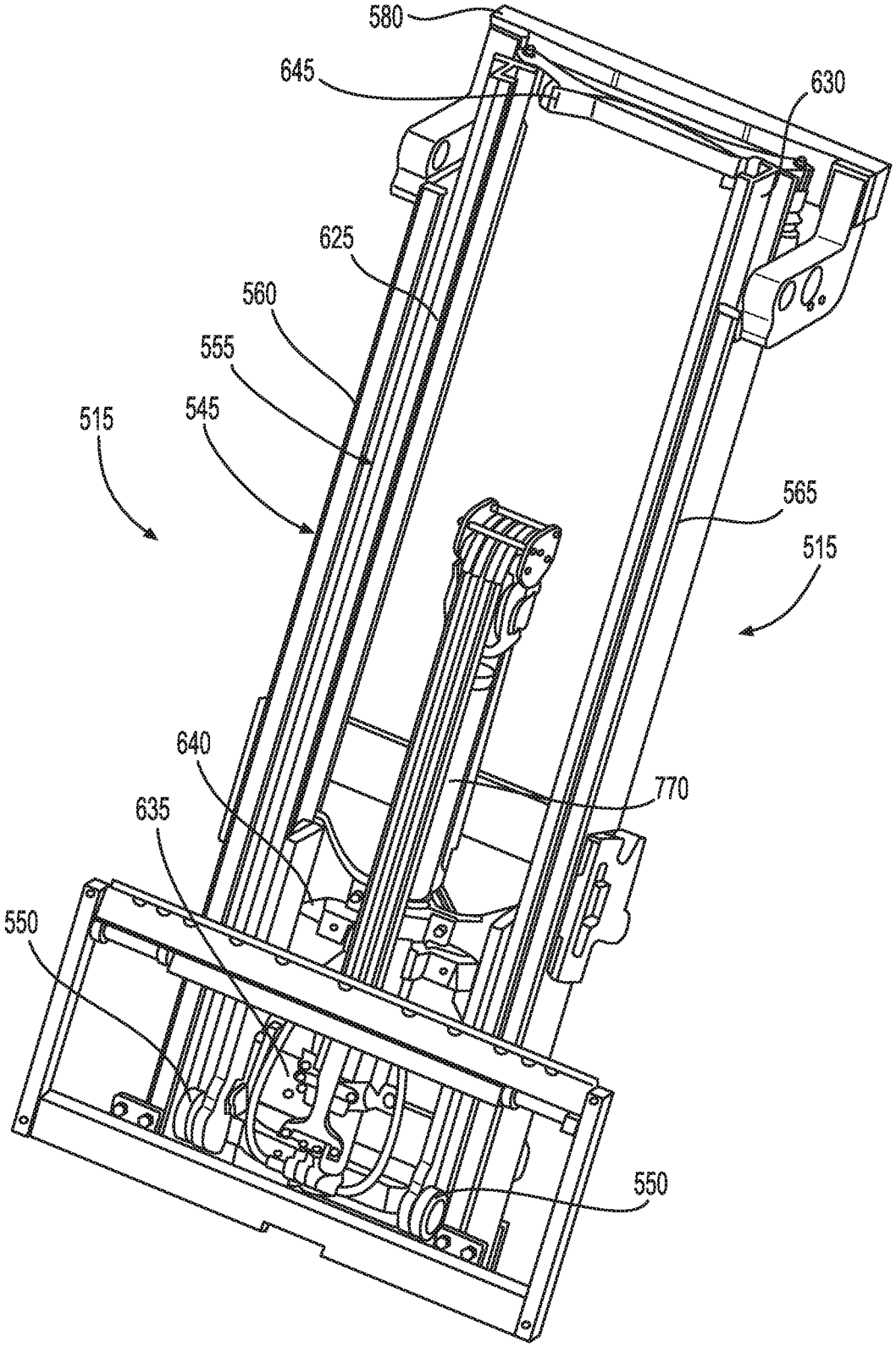
FIG. 20 illustrates a front orthogonal view of the mast of FIG. 19.

An exemplary two stage mast 510 is illustrated in FIGS. 19 and 20. Mast 510 includes a base section 545 comprising base rails 560 and 565 that are identical in construction to base rails 60 and 65. Mast 510 also includes an inner section 555 comprising inner rails 625 and 630 that are identical in construction to inner rails 125 and 130. Rollers 550 (FIG. 20) are secured to the carriage 540 and each engage a substantially flat surface of the inner section 555, for example, as illustrated in FIG. 19. Rollers (not illustrated) are secured proximate to the top of the base section 545 and engage the forward facing portion of projection portion 705. Other rollers (not illustrated) are secured proximate to the bottom of the inner section 555 and engage the forward facing portion of the rear flanges 560 of the base section 545. Rollers reduce contact between the components of mast 510 (for example, compared to not having rollers) and enable a relatively low friction interaction between the components of mast 510 because of the rotational movement of the rollers. Other sliding engagement supports, for example, a pad of low friction material made from high-density polyethylene, ultra-high molecular weight polyethylene, or other suitable material, may be used in place of rollers.

Figure 15:
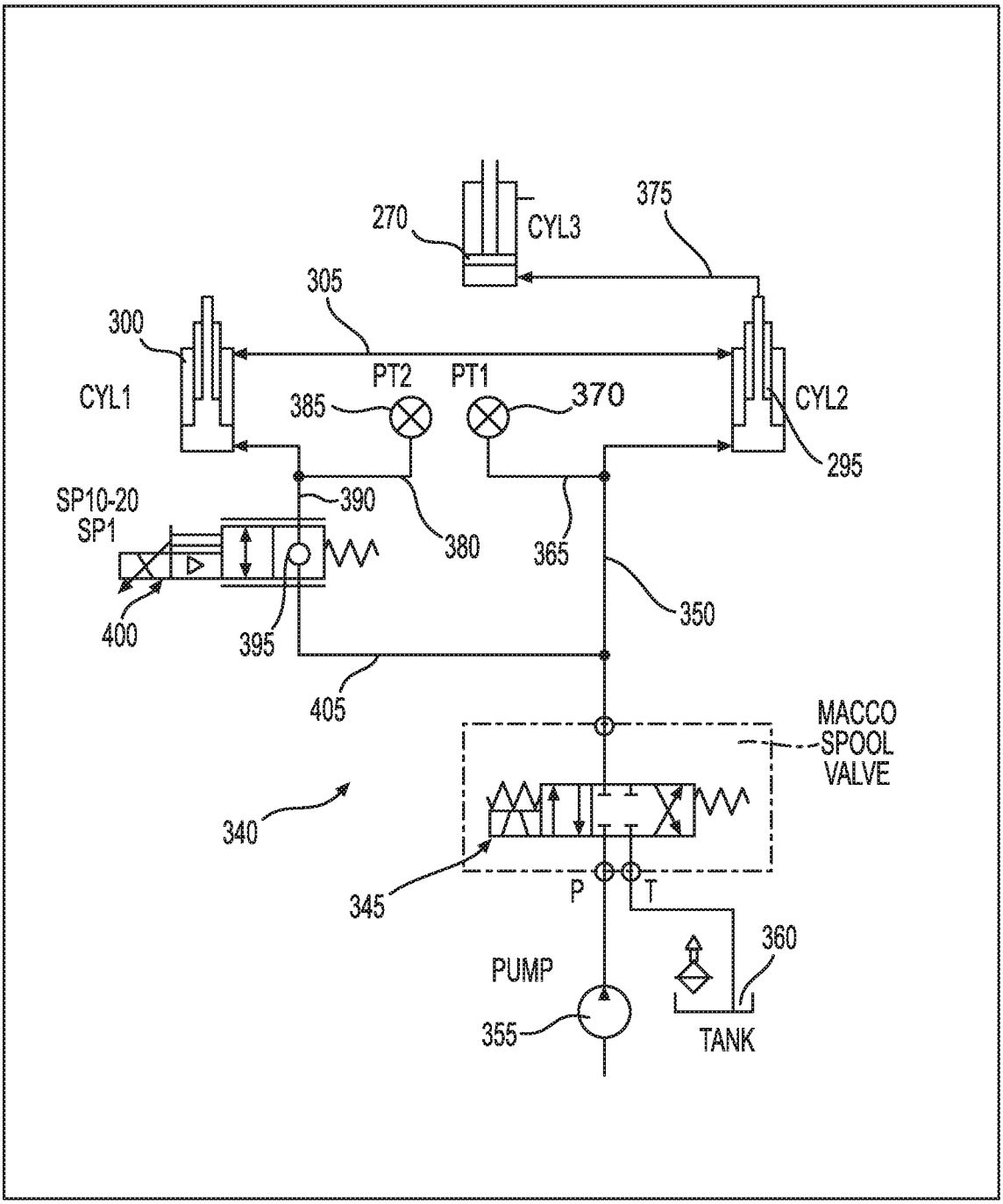
FIG. 15 illustrates a schematic diagram for an illustrative hydraulic circuit.

An exemplary hydraulic circuit used with mast 510 is similar to the hydraulic circuit illustrated in FIG. 15. However, single acting hydraulic cylinders are secured to the base section 545 at a lower end and to the inner section 555 at an upper end, for example, to upper crosstie 645 instead of double acting cylinders. A hydraulic pump 355 supplies pressurized hydraulic fluid to the bottom of each of the single acting hydraulic cylinders, and the single acting hydraulic cylinders are not connected via a balance pipe. Other suitable hydraulic circuits may be used with a mast such as mast 510.

Additional Embodiment

Viewed from the top of a lift truck, such as lift truck 5, FIG. 21 illustrates the shape and positioning of the right-side rails 860, 890, and 925 that make up one mast column 815 of an alternate embodiment. Base rail 860 is substantially ɔ-shaped (in other words, a reverse "C" shape) and includes a forward flange 955 and a rear flange 960 that are connected by a web 965. Forward flange 955 is distal from the front portion 35 of the lift truck 5, while rear flange 960 is proximate the front portion 35 of the lift truck 5.

The b-shaped middle rail 890 nests with the base rail 860. The b-shaped middle rail 890 comprises a curved web 980 that forms a tail 975 that is located between the rear flange 960 of the base rail 860 and the front portion 35 of the lift truck 5. Curved web 980 includes a bulbous portion 985. The bulbous portion 985 extends towards web 965 of the base rail 860 and is located proximate the rear flange 960 of the base rail 860.

The ɔ-shaped (in other words, reverse "c" shape) inner rail 925 nests with the b-shaped middle rail 890. The ɔ-shaped inner rail 925 includes a forward flange 990 and a rear flange 995 connected by a web 1000. Forward flange 990 is substantially aligned with the forward flange 955 of the base rail 860 and rear flange 995 is located proximate the middle of web 965 of the base rail 860. A projecting portion 1005 extends from the web 1000 into a channel created by the bulbous portion 985 of the middle rail 890.

Rails 865, 895, and 930 (not illustrated) are identical to rails 860, 890, and 925, but are rotated by 180 degrees. That is, a top view of rails 865, 895, and 930 is a mirror image of what is illustrated in FIG. 21.

EXAMPLES

First Example

A lift truck, comprising an operator compartment, a front portion on one side of the operator compartment, and a mast positioned such that the front portion is between the mast and the operator compartment, the mast comprising a left-side mast column and a right-side mast column, wherein the left-side mast column comprises (a) a left-side base rail having, when viewed from above the lift truck, a substantially C-shaped cross section formed by a forward flange portion distal from the front portion of the lift truck, a rearward flange portion proximate the front portion of the lift truck, and a web portion connecting the forward and rearward flange portions, and (b) a left-side inner rail nested with the left-side base rail, the left-side inner rail having, when viewed from above the lift truck, a substantially c-shaped cross section formed by a forward flange portion located proximate the forward flange portion of the base rail, a rearward flange portion located proximate the rearward flange portion of the base rail, a web portion connecting the forward flange portion with the rearward flange portion of the inner rail, and a projecting portion extending toward the base rail; and the right-side mast column comprises a right-side base rail and a right-side inner rail that are mirror images of the left-side base rail and the left-side inner rail when viewed from above the lift truck.

Second Example

A lift-truck according to the first example, wherein the left-side mast column and the right side mast column each have a width in the range of 8 cm to 11 cm.

Third Example

A lift truck according to the first example, further comprising a left-side middle rail nested between the left-side base rail and the left-side inner rail, the left-side middle rail comprising, when viewed from above the lift truck, a substantially reverse b-shaped cross section formed by a web shaped to have a tail portion located proximate the rearward flange portion of the base rail, the web having a bulbous portion positioned between the forward flange portion and the rearward flange portion of the base rail and located proximate the rearward flange portion of the base rail such that the bulbous portion extends towards the web of the base rail; and a right-side middle rail nested between the right-side base rail and the right-side inner rail, the right-side middle rail comprising, when viewed from above the lift truck, a mirror image of the left-side middle rail.

Fourth Example

A lift truck according to the third example, wherein the left-side middle rail further comprises a forward flange portion located proximate the forward flange portion of the base rail; and the web of the left-side middle rail connects the forward flange portion with the rearward flange portion of the middle rail.

Fifth Example

A lift-truck according to the third example, wherein the left-side mast column and the right side mast column each have a width in the range of 10 cm to 13 cm.

Sixth Example

A lift-truck according to the third example, wherein the projecting portion of the left-side inner rail projects into a channel created by the bulbous portion of the left-side middle rail.

Seventh Example

A lift truck according to the first example, further comprising a left-side middle rail nested between the left-side base rail and the left-side inner rail, the left-side middle rail comprising when viewed from above the lift truck, a substantially S-shaped cross section formed by a forward flange portion located proximate the forward flange portion of the base rail, a rearward flange portion located proximate the rearward flange portion of the base rail such that the rearward flange portion of the middle rail is positioned between the rearward flange portion of the base rail and the front portion of the lift truck, and a web portion connecting the forward flange portion with the rearward flange portion of the middle rail and having a first curved portion positioned between the forward flange portion and the rearward flange portion of the base rail and located proximate the forward flange portion of the base rail such that the first curved portion extends towards the web of the base rail and a second curved portion that extends away from the web of the base rail; and a right-side middle rail nested between the right-side base rail and the right-side inner rail, the right-side middle rail comprising, when viewed from above the lift truck, a mirror image of the left-side middle rail.

Eighth Example

A lift-truck according to the seventh example, wherein the left-side mast column and the right side mast column each have a width in the range of 10 cm to 13 cm.

Ninth Example

A lift-truck according to the seventh example, wherein the projecting portion of the left-side inner rail projects into a channel created by the first curved portion of the left-side middle rail.

Tenth Example

A lift truck comprising a mast having two mast columns and a hydraulic circuit, wherein the hydraulic circuit comprises a pass-through, double acting hydraulic cylinder located proximate one column of the mast, the pass-through, double acting hydraulic cylinder bearing a check valve located to communicate hydraulic fluid to and from an inner cylinder; a double acting hydraulic cylinder located proximate the other column of the mast; a conduit for communicating hydraulic fluid between the pass-through, double acting hydraulic cylinder and the double acting hydraulic cylinder; a free-lift cylinder connected between the mast and a carriage borne by the mast; a conduit for communicating hydraulic fluid between the pass-through, double acting hydraulic cylinder and the free-lift cylinder; a pump fluidly communicating with the pass-through, double acting hydraulic cylinder and the double acting hydraulic cylinder; a proportional valve interposed between the pump and the pass-through, double acting hydraulic cylinder; and a second valve interposed between the pump and the double acting hydraulic cylinder; wherein operation of the proportional valve and the second valve occurs via a controller when the controller receives lift and lower signals from the lift truck.

Eleventh Example

A lift truck according to the tenth example, wherein a surface acted upon by hydraulic fluid to move the inner cylinder of the pass-through, double acting hydraulic cylinder and a surface area acted upon by hydraulic fluid to move an inner cylinder of the double acting hydraulic cylinder are sized such that the inner cylinder of the pass-through, double acting hydraulic cylinder and the inner cylinder of the double acting hydraulic cylinder extend at matching rates.

Twelfth Example

A lift truck according to the eleventh example, wherein a surface acted upon by hydraulic fluid to move an intermediate cylinder of the pass-through, double acting hydraulic cylinder and a surface area acted upon by hydraulic fluid to move an intermediate cylinder of the double acting hydraulic cylinder are sized such that the intermediate cylinder of the pass-through, double acting hydraulic cylinder and the intermediate cylinder of the double acting hydraulic cylinder extend at matching rates.

Thirteenth Example

A lift truck according to the twelfth example, wherein the surface acted upon by hydraulic fluid to move the inner cylinder of the pass-through, double acting hydraulic cylinder, the surface area acted upon by hydraulic fluid to move the inner cylinder of the double acting hydraulic cylinder, the surface acted upon by hydraulic fluid to move the intermediate cylinder of the pass-through, double acting hydraulic cylinder and the surface area acted upon by hydraulic fluid to move the intermediate cylinder of the double acting hydraulic cylinder are all sized such that the inner cylinder of the pass-through, double acting hydraulic cylinder, the inner cylinder of the double acting hydraulic cylinder, the intermediate cylinder of the pass-through, double acting hydraulic cylinder and the intermediate cylinder of the double acting hydraulic cylinder all extend at matching rates.

Fourteenth Example

A lift truck according to the tenth example, wherein the mast comprises a base section, a middle section, and an inner section, the mast further comprising a first sensor arrangement communicating with the controller, the first sensor arrangement located on the mast such that the first sensor arrangement detects when a carriage is within a predetermined distance of the top of the base section; and a second sensor arrangement communicating with the controller, the second sensor arrangement located on the mast such that the second sensor arrangement detects when the middle section is within a predetermined distance of the base section.

The foregoing is a detailed description of illustrative embodiments of the invention using specific terms and expressions. Various modifications and additions can be made without departing from the spirit and scope thereof. Therefore, the invention is not limited by the above terms and expressions, and the invention is not limited to the exact construction and operation shown and described. On the contrary, many variations and embodiments are possible and fall within the scope of the invention which is defined only by the claims that follow.

The invention claimed is:

1. A hydraulic arrangement for an extensible mast comprising:

a hydraulic pump fluidly communicating with a hydraulic reservoir;

a hydraulic feed-through cylinder connected to a first mast column such that extension of the feed-through cylinder moves a section of the mast;

a first valve arrangement fluidly interposed between the pump and the reservoir on one side of the first valve arrangement and via a first hydraulic line to the feed-through cylinder on another side of the first valve arrangement such that the first valve arrangement controls fluid communication between the pump and the feed-through cylinder and also controls fluid communication between the feed-through cylinder and the reservoir;

a hydraulic free-lift cylinder fluidly communicating with the feed-through cylinder such that hydraulic fluid is communicated to and from the free-lift cylinder via the feed-through cylinder;

a hydraulic lift cylinder connected to a second mast column such that extension of the lift cylinder moves the section of the mast;

a second valve arrangement fluidly interposed between the pump and via a second hydraulic line to the lift cylinder such that the second valve arrangement controls fluid communication between the pump and the lift cylinder;

a balance pipe fluidly connecting the feed-through cylinder with the lift cylinder; and a controller operably connected with the first valve arrangement and with the second valve arrangement wherein the controller operates the first valve arrangement and the second valve arrangement.

2. A hydraulic arrangement for an extensible mast, comprising:

a hydraulic pump fluidly communicating with a hydraulic reservoir;

a hydraulic feed-through cylinder connected to a first mast column such that extension of the feed-through cylinder moves a section of the mast;

a first valve arrangement fluidly interposed between the pump and the reservoir on one side of the first valve arrangement and the feed-through cylinder on another side of the first valve arrangement such that the first valve arrangement controls fluid communication between the pump and the feed-through cylinder and also controls fluid communication between the feed-through cylinder and the reservoir;

a hydraulic free-lift cylinder fluidly communicating with the feed-through cylinder such that hydraulic fluid is communicated to and from the free-lift cylinder via the feed-through cylinder;

a hydraulic lift cylinder connected to a second mast column such that extension of the lift cylinder moves the section of the mast;

a balance pipe fluidly connecting the feed-through cylinder with the lift cylinder;

a second valve arrangement fluidly interposed between the pump and the lift cylinder such that the second valve arrangement controls fluid communication between the pump and the lift cylinder;

a controller operably connected with the first valve arrangement and with the second valve arrangement wherein the controller operates the first valve arrangement and the second valve arrangement;

a first pressure sensor communicating with the controller and arranged to sense pressure of hydraulic fluid supplied to the feed-through cylinder; and a second pressure sensor communicating with the controller and arranged to sense pressure of hydraulic fluid supplied to the lift cylinder;

wherein the controller is configured to operate the first valve arrangement and the second valve arrangement based at least in part on pressures sensed by the first pressure sensor and the second pressure sensor.

3. A hydraulic arrangement according to claim 2, wherein:

the mast comprises a three-section mast;

the feed-through cylinder comprises a double acting hydraulic cylinder comprising an outer cylinder, an intermediate cylinder contained in the outer cylinder, and an inner cylinder contained in the intermediate cylinder, wherein the feed-through cylinder is connected to the three-section mast such that extension of the intermediate cylinder moves a first section of the three-section mast and extension of the inner cylinder moves a second section of the three-section mast; and the lift cylinder comprises a double acting hydraulic cylinder comprising an outer cylinder, an intermediate cylinder contained in the outer cylinder, and an inner cylinder contained in the intermediate cylinder, wherein the lift cylinder is connected to the three-section mast such that extension of the intermediate cylinder moves the first section of the three-section mast and extension of the inner cylinder moves the second section of the three-section mast.

4. A hydraulic arrangement according to claim 3, wherein the balance pipe fluidly connects an annular space between the intermediate cylinder and the outer cylinder of the feed-through cylinder with an annular space between the intermediate cylinder and the outer cylinder of the lift cylinder.

5. A hydraulic arrangement according to claim 4, further comprising:

one or more ports formed in the inner cylinder of the feed-through cylinder to fluidly communicate an interior of the inner cylinder with an annular space formed between the inner cylinder and the intermediate cylinder;

one or more ports formed in the intermediate cylinder of the feed-through cylinder to fluidly communicate the annular space formed between the inner cylinder and the intermediate cylinder with an annular space between the intermediate cylinder and the outer cylinder;

one or more ports formed in the inner cylinder of the lift cylinder to fluidly communicate an interior of the inner cylinder with an annular space formed between the inner cylinder and the intermediate cylinder; and one or more ports formed in the intermediate cylinder of the lift cylinder to fluidly communicate the annular space formed between the inner cylinder and the intermediate cylinder with an annular space between the intermediate cylinder and the outer cylinder.

6. A hydraulic arrangement according to claim 5, further comprising a check valve located at a bottom end of the inner cylinder of the feed-through cylinder where hydraulic fluid from the pump is introduced to the feed-through cylinder.

7. A hydraulic arrangement according to claim 6, further comprising a mechanical device sized and located such that when the inner cylinder and the intermediate cylinder of the feed-through cylinder are at their lowermost position the check valve located at the bottom end of the inner cylinder is mechanically held open.

8. A hydraulic arrangement according to claim 7, wherein the mechanical device comprises a shelf formed in an inlet where hydraulic fluid from the pump is introduced to the feed-through cylinder.

9. A hydraulic arrangement according to claim 7, wherein the second valve arrangement fluidly communicates with a hydraulic line connected between the first valve arrangement and the feed-through cylinder.

10. A hydraulic arrangement according to claim 9, wherein the second valve arrangement includes a check valve that inhibits, but does not prevent, fluid communication from the lift cylinder to the hydraulic line connected between the first valve arrangement and the feed-through cylinder.

11. A hydraulic arrangement according to claim 10, wherein the first valve arrangement comprises a solenoid valve and the second valve arrangement comprises a solenoid valve.

12. A method of operating a lift mast comprising a first section, a second section moveable within the first section, a third section moveable within the second section, and a carriage moveable within the third section, the method comprising:

receiving a lift command at a controller;

in response to receiving the lift command, activating a pump via the controller and opening a first valve arrangement via the controller such that the pump fluidly communicates with a feed-through cylinder;

providing pressurized hydraulic fluid to a free-lift cylinder via the pump through the first valve arrangement and through the feed-through cylinder; and in response to receiving the lift command, keeping a second valve arrangement closed via the controller such that pressurized fluid is communicated from the feed-through cylinder to a lift cylinder via a balance pipe, but pressurized fluid is not supplied to the lift cylinder from the pump through the second valve arrangement.

13. A method of operating a lift mast according to claim 12 further comprising:

receiving a first sensor signal at the controller, wherein the first sensor signal indicates that the carriage is within a predetermined distance of the top of the third section;

receiving a second sensor signal at the controller, wherein the second sensor signal indicates that the second section is within a predetermined distance from its resting location with respect to the first section; and via the controller and based at least in part on the first sensor signal and the second sensor signal, opening the second valve arrangement, at least partially, to facilitate balancing a pressure increase in both the feed-through cylinder and the lift cylinder.

14. A method of operating a lift mast according to claim 13 further comprising:

receiving a third sensor signal at the controller, wherein the third sensor signal indicates a hydraulic pressure associated with the feed-through cylinder;

receiving a fourth sensor signal at the controller, wherein the fourth sensor signal indicates a hydraulic pressure associated with the lift cylinder; and via the controller, and based at least in part on the first sensor signal, the second sensor signal, the third sensor signal and the fourth sensor signal, opening the second valve arrangement, at least partially, to facilitate balancing a pressure increase in both the feed-through cylinder and the lift cylinder.

15. A method of operating a lift mast according to claim 12 further comprising:

after receiving the lift command at the controller, receiving a lower command at the controller;

receiving a first sensor signal at the controller, wherein the first sensor signal indicates that the carriage is within a predetermined distance of the top of the third section;

receiving a second sensor signal at the controller, wherein the second sensor signal indicates that the second section is not within a predetermined distance from its resting location with respect to the first section;

in response to receiving the lower command, deactivating the pump via the controller; and via the controller, and based at least in part on the first sensor signal and the second sensor signal, opening the first valve arrangement and opening the second valve arrangement to lower the third section and the second section of the mast.

16. A method of operating a lift mast according to claim 15 further comprising:

continuing to receive the lower command at the controller;

continuing to receive the first sensor signal at the controller, wherein the first sensor signal indicates that the carriage is within a predetermined distance of the top of the third section;

continuing to receive the second sensor signal at the controller, wherein the second sensor signal indicates that the second section is within a predetermined distance from its resting location with respect to the first section;

via the controller, and based at least in part on the first sensor signal and the second sensor signal, closing the second valve arrangement and operating the first valve arrangement to lower the carriage.

17. A hydraulic arrangement according to claim 1, further comprising:

a first pressure sensor communicating with the controller and arranged to sense pressure of hydraulic fluid supplied to the feed-through cylinder; and a second pressure sensor communicating with the controller and arranged to sense pressure of hydraulic fluid supplied to the lift cylinder;

wherein the controller is configured to operate the first valve arrangement and the second valve arrangement based at least in part on pressures sensed by the first pressure sensor and the second pressure sensor.

18. A hydraulic arrangement according to claim 1, wherein:

the mast comprises a three-section mast;

the feed-through cylinder comprises a double acting hydraulic cylinder comprising an outer cylinder, an intermediate cylinder contained in the outer cylinder, and an inner cylinder contained in the intermediate cylinder, wherein the feed-through cylinder is connected to the three-section mast such that extension of the intermediate cylinder moves a first section of the three-section mast and extension of the inner cylinder moves a second section of the three-section mast; and the lift cylinder comprises a double acting hydraulic cylinder comprising an outer cylinder, an intermediate cylinder contained in the outer cylinder, and an inner cylinder contained in the intermediate cylinder, wherein the lift cylinder is connected to the three-section mast such that extension of the intermediate cylinder moves the first section of the three-section mast and extension of the inner cylinder moves the second section of the three-section mast.

19. A hydraulic arrangement according to claim 18, wherein the balance pipe fluidly connects an annular space between the intermediate cylinder and the outer cylinder of the feed-through cylinder with an annular space between the intermediate cylinder and the outer cylinder of the lift cylinder.

20. A hydraulic arrangement according to claim 19, further comprising:

one or more ports formed in the inner cylinder of the feed-through cylinder to fluidly communicate an interior of the inner cylinder with an annular space formed between the inner cylinder and the intermediate cylinder;

one or more ports formed in the intermediate cylinder of the feed-through cylinder to fluidly communicate the annular space formed between the inner cylinder and the intermediate cylinder with an annular space between the intermediate cylinder and the outer cylinder;

one or more ports formed in the inner cylinder of the lift cylinder to fluidly communicate an interior of the inner cylinder with an annular space formed between the inner cylinder and the intermediate cylinder; and one or more ports formed in the intermediate cylinder of the lift cylinder to fluidly communicate the annular space formed between the inner cylinder and the intermediate cylinder with an annular space between the intermediate cylinder and the outer cylinder.

21. A hydraulic arrangement according to claim 20, further comprising a check valve located at a bottom end of the inner cylinder of the feed-through cylinder where hydraulic fluid from the pump is introduced to the feed-through cylinder.

22. A hydraulic arrangement according to claim 21, further comprising a mechanical device sized and located such that when the inner cylinder and the intermediate cylinder of the feed-through cylinder are at their lowermost position the check valve located at the bottom end of the inner cylinder is mechanically held open.

23. A hydraulic arrangement according to claim 22, wherein the mechanical device comprises a shelf formed in an inlet where hydraulic fluid from the pump is introduced to the feed-through cylinder.

24. A hydraulic arrangement according to claim 22, wherein the second valve arrangement fluidly communicates with a hydraulic line connected between the first valve arrangement and the feed-through cylinder.

25. A hydraulic arrangement according to claim 24, wherein the second valve arrangement includes a check valve that inhibits, but does not prevent, fluid communication from the lift cylinder to the hydraulic line connected between the first valve arrangement and the feed-through cylinder.

26. A hydraulic arrangement according to claim 25, wherein the first valve arrangement comprises a solenoid valve and the second valve arrangement comprises a solenoid valve.

* * * * *